US008851643B2

(12) United States Patent
Tsubaki et al.

(10) Patent No.: US 8,851,643 B2
(45) Date of Patent: Oct. 7, 2014

(54) INKJET IMAGE FORMING APPARATUS

(71) Applicants: Kengo Tsubaki, Kanagawa (JP); Hiroyoshi Komaba, Kanagawa (JP); Tatsuro Watanabe, Kanagawa (JP); Yoshiya Itoh, Kanagawa (JP); Hiroyuki Hiratsuka, Kanagawa (JP)

(72) Inventors: Kengo Tsubaki, Kanagawa (JP); Hiroyoshi Komaba, Kanagawa (JP); Tatsuro Watanabe, Kanagawa (JP); Yoshiya Itoh, Kanagawa (JP); Hiroyuki Hiratsuka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/013,647

(22) Filed: Aug. 29, 2013

(65) Prior Publication Data

US 2014/0063141 A1 Mar. 6, 2014

(30) Foreign Application Priority Data

Aug. 30, 2012 (JP) ..... 2012-189740
Jan. 7, 2013 (JP) ..... 2013-000427

(51) Int. Cl.
*B41J 2/175* (2006.01)
*B41J 2/17* (2006.01)

(52) U.S. Cl.
CPC ..... *B41J 2/175* (2013.01)
USPC ..... 347/85; 347/84; 347/86

(58) Field of Classification Search
USPC ..... 347/84, 85, 86
See application file for complete search history.

(56) References Cited

U.S. PATENT DOCUMENTS

| | | | | |
|---|---|---|---|---|
| 7,121,643 | B2 | 10/2006 | Yamada | |
| 7,425,059 | B2 | 9/2008 | Kudo et al. | |
| 7,661,798 | B2 | 2/2010 | Mukai et al. | |
| 8,136,916 | B2 | 3/2012 | Nemoto et al. | |
| 8,465,125 | B2 | 6/2013 | Tsubaki et al. | |
| 8,465,134 | B2 | 6/2013 | Watanabe | |
| 8,480,214 | B2 | 7/2013 | Tsubaki | |
| 2011/0181670 | A1* | 7/2011 | Tsubaki | 347/85 |
| 2012/0050425 | A1 | 3/2012 | Watanabe | |
| 2012/0062659 | A1 | 3/2012 | Tsubaki | |
| 2013/0235131 | A1* | 9/2013 | Watanabe et al. | 347/86 |

FOREIGN PATENT DOCUMENTS

| | | |
|---|---|---|
| JP | 2001-337510 | 12/2001 |
| JP | 2004-268454 | 9/2004 |
| JP | 2005-169892 | 6/2005 |
| JP | 2005-329709 | 12/2005 |
| JP | 2007-168421 | 7/2007 |
| JP | 2011-148224 | 8/2011 |

* cited by examiner

*Primary Examiner* — Jannelle M Lebron
(74) *Attorney, Agent, or Firm* — Cooper & Dunham LLP

(57) ABSTRACT

An inkjet image forming apparatus which is provided with a line engine in which one or more recording heads are aligned in a main scanning direction and which has replacably configured an arbitrary one of the recording heads is disclosed. In the inkjet image forming apparatus, each of the recording heads includes a head tank mounted on the recording head, the head tank including a supply port and a discharge port for ink, the head tanks which are adjacent are mutually connected by a path in which the discharge port and supply port of the respective head tanks are coupled via a coupling unit, a path from the discharge port and a path to the supply port differ in an inner path diameter over the coupling unit, and the inner path diameter on the discharge port side is larger than the inner path diameter on the supply port side.

16 Claims, 31 Drawing Sheets

- AIR BUBBLES ARE DIFFICULT TO RISE
- FLUID RESISTANCE : LARGE

- AIR BUBBLES ARE DIFFICULT TO FALL
- FLUID RESISTANCE : SMALL

- AIR BUBBLES ARE EASY TO FALL AND DIFFICULT TO RISE
- FLUID RESISTANCE : SMALL

INKJET IMAGE FORMING APPARATUS

TECHNICAL FIELD

The present invention relates to inkjet image forming apparatuses which include a line engine.

BACKGROUND ART

There are line inkjet-type inkjet recording and image forming apparatuses which eject ink droplets from a recording head to perform recording, the devices including a line engine in which multiple recording heads (below simply called "heads") are lined up in a main scanning direction. In such a line engine configuration, a configuration which makes it possible to replace one recording head is already known.

In the line engine in which the multiple heads are lined up, an ink supply flow path becomes long and also an amount of ink supplied becomes large. Therefore, a fluid resistance to a head from a sub tank provided in a body of the apparatus increases, so that a pressure loss becomes greater. The pressure loss leads to a shortage in ink supply, causing ejection failures (bending, non-ejection, entraining of air from a nozzle).

Nevertheless, when the ink supply flow path is thickened, a whole machine size becomes larger or air bubbles remain at the time of initial loading into the supply path. The remaining air bubbles block up the flow path, the flow path becomes thin, so that the fluid resistance increases, causing the pressure loss to become greater. Then, there is a problem that a shortage in ink supply occurs, causing ejection failures (bending, non-ejection, entraining of air from a nozzle).

JP2007-168421A (Patent Document 1) discloses that, with an aim to increase a speed of supplying liquid to a nozzle by decreasing a pressure loss and a liquid flow path resistance within a liquid ejection head, an ink supply chamber 44 is arranged to be laminated with a main ink supply chamber 42, and a filter 40 which intervenes between the main ink supply chamber 42 and the ink supply chamber 44 is arranged to extend along a face which is generally parallel to a nozzle arrangement plane on which multiple nozzles are lined up.

Moreover, JP2011-148224A (Patent Document 2) discloses that, with an aim to efficiently discharge air bubbles within a head tank, a filter member is provided in a head tank, the filter member dividing an upstream chamber and a downstream chamber, a supply path which provides ink from a downstream portion of an ink container to a head and a discharge path which discharges to the outside ink discharged from a discharge outlet portion of the head.

However, reduction in the pressure loss is not sufficient even with these related art techniques. Therefore, a problem of ejection failures occurring has not been solved. Moreover, an efficient discharging of air bubbles at the time of replacing one head or at the time of initial loading has not been achieved.

RELATED ART DOCUMENT

Patent Documents

Patent Document 1 JP2006-259176A
Patent Document 2 JP2010-012227A

DISCLOSURE OF THE INVENTION

Thus, an object of the present invention is to provide a line inkjet-type recording apparatus which may solve the above-mentioned problem in the related art apparatus which includes a line engine, efficiently discharging air bubbles within a head tank and decreasing fluid resistance in an ink flow path to a recording head to decrease a pressure loss to thereby perform a stable ejection.

According to an embodiment of the present invention, an inkjet image forming apparatus which is provided with a line engine in which one or more recording heads are aligned in a main scanning direction and which has replacably configured an arbitrary one of the recording heads is provided, wherein each of the recording heads includes a head tank mounted on the recording head, the head tank including a supply port and a discharge port for ink, wherein the head tanks which are adjacent are mutually connected by a path in which the discharge port and supply port of the respective head tanks are coupled via a coupling unit, wherein a path from the discharge port and a path to the supply port differ in an inner path diameter over the coupling unit, and wherein the inner path diameter on the discharge port side is larger than the inner path diameter on the supply port side.

The present invention makes it possible, at the time of replacing one head or at the time of initial loading, to efficiently and speedily discharge air bubbles within a head tank with a small passing liquid amount and decrease fluid resistance in an ink flow path to a recording head and decrease a pressure loss to thereby perform a stable ink ejection.

BRIEF DESCRIPTION OF THE DRAWINGS

Other objects, features, and advantages of the present invention will become more apparent from the following detailed descriptions when read in conjunction with the accompanying drawings, in which.

BEST MODE FOR CARRYING OUT THE INVENTION

Below, embodiments of the present invention are explained with reference to the drawings.

Figure 1:
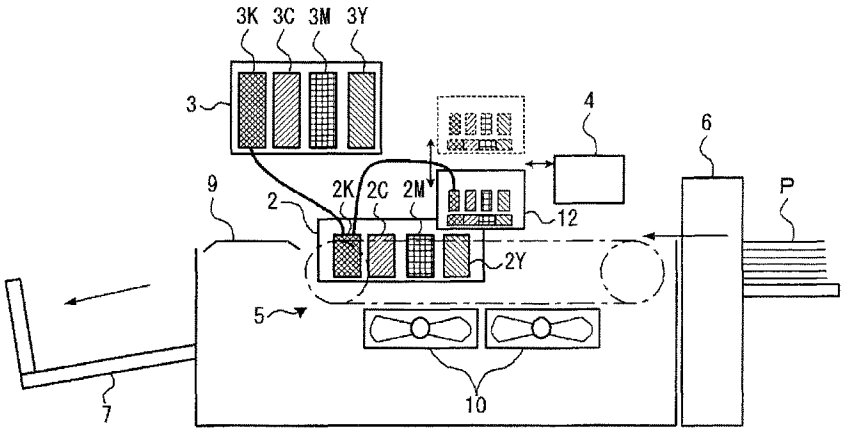
FIG. 1 is a configuration diagram illustrating a schematic configuration in one example of a line inkjet-type image forming apparatus according to the embodiments of the present invention.

FIG. 1 is a configuration diagram illustrating a schematic configuration in one example of a line-type inkjet image forming apparatus according to embodiments of the present invention. The above-mentioned inkjet image forming apparatus is an inkjet-type image forming apparatus which includes a line engine in which a head which ejects liquid droplets from a nozzle is arranged in multiple numbers in a main scanning direction.

FIG. 1 shows a head unit 12 which is mounted with a line engine having a line configuration of multiple sequences (four sequences in the present example), wherein the head unit 12 is arranged at an upper portion of a conveying unit 5. The conveying unit 5 adsorbs a sheet P fed from a sheet-supplying unit 6 to a conveying belt 11 to convey the adsorbed sheet in a direction shown that is from the right to the left as shown with arrows. Ink droplets are caused to be ejected from a recording head onto an upper face of the sheet P conveyed by the conveying unit 5 to perform image recording.

The conveying belt 11 of the conveying unit 5 is pierced and suctions air with a suctioning fan 10 arranged at a lower portion of the conveying unit, so that the sheet is conveyed with a back face thereof adsorbed to the conveying belt 11. The sheet P which is subjected to image recording by the head unit 12 passes over a guide plate 9 to be discharged and stacked onto a sheet-discharging platform 7. A cleaning unit 4 is provided adjacent to the head unit 12.

As for a configuration of an ink supply system, ink of respective colors (the ink of the respective colors of K: black, C: cyan, M: magenta, and Y: yellow; four colors shown with a difference in a fill pattern) is sent first to a sub tank for respective colors (2K, 2C, 2M, 2Y) that is arranged within a sub tank unit 2 from an ink cartridge of respective colors (3K, 3C, 3M, 3Y) that is set in an ink cartridge unit 3, after which it is supplied to a recording head of each line. In order to avoid complexity, only for black (K) is shown a supply flow path (a supply tube, etc.) which connects the ink cartridge 3K to the sub tank 2K to the recording head. Similarly for the other three colors (C, M, Y), a connection is made from the ink cartridge to the sub tank to the recording head with the supply flow path.

The sub tank (2K, 2C, 2M, 2Y) is configured such that a spring is placed therein and a flexible film is adhered on one face of the sub tank to push the spring inside thereagainst, adopting a natural supplying scheme in which a negative head pressure is formed due to a returning force of the spring.

In a method of cleaning the recording head, first the head unit 12 evacuates upward as shown in broken lines, and a cleaning unit 4 slides to get into a space formed between the conveying unit 5 and the head unit 12. Next, the head unit 12 moves down onto the cleaning unit 4, and cleans the recording head with a pump suctioning unit (not shown) suctioning ink within the head. When cleaning is completed, the head unit 12 again evacuates upward and the cleaning unit 4 returns to a position shown. Then, the head unit 12 moves down to a predetermined position on a sheet conveying face of the conveying unit 5, so that recording can be performed.

Figure 10:
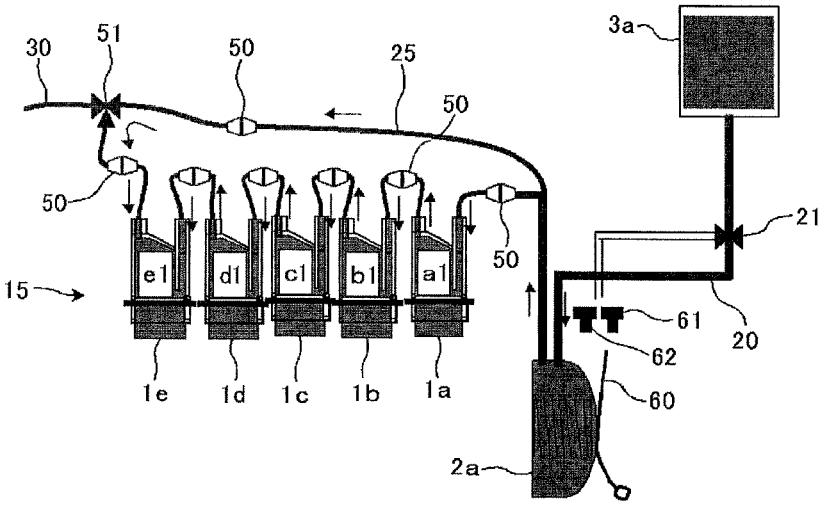
FIG. 10 is a diagram for describing the ink supply system in the inkjet image forming apparatus in an application filed by the present applicant separately from the present application.

Here, for comparison with the present invention, a system which supplies ink into a line engine in an inkjet image forming apparatus for which a separate filing was made by an applicant of the present application is described using FIG. 10. In order to provide explanations without distinguishing colors, explanations are made for an ink cartridge 3*a*, a sub tank 2*a*, and a line head 15.

As shown in FIG. 10, the line head 15 for one line includes five recording heads 1*a*, 1*b*, 1*c*, 1*d*, and 1*e* in the present example. Each of the recording heads (ejecting heads) 1*a*, 1*b*, 1*c*, 1*d*, 1*e* is respectively provided with head tanks a1, b1, c1, d1, and e1. The head and the head tank make up a head module, which head module is to be replaced when the head is to be replaced. Multiple head modules are lined up in one column in a main scanning direction (a direction orthogonal to a sheet conveying direction) to make up the line head 15.

The ink cartridge 3*a* is connected to the sub tank 2*a* by a supply flow path 20, and then the sub tank 2*a* is connected to the head tank a1 of a head module on the uppermost stream side by the supply flow path 20. In the supply flow path 20 between the ink cartridge 3*a* and the sub tank 2*a* is provided an ink supply valve (opening and closing valve) 21. Moreover, in the supply flow path 20 between the sub tank 2*a* and the head tank 1*a* is provided a coupling 50 used for head replacement. Then, the respective head modules are serially connected to a supply flow path (no letter). The coupling 50 (letter omitted in the drawings to avoid complexity) is also provided at a supply flow path between the respective head modules.

Moreover, a bypass supply flow path 25 which bypasses the respective head modules (line heads) is provided. The coupling 50 is provided in the middle of the bypass supply flow path. The upstream side of the bypass supply flow path 25 is connected to the sub tank 2*a*, (branching from the flow path 20), while the downstream side thereof is connected to the head tank e1 of a lowermost stream head module and a waste liquid flow path 30 via a tri-directional valve 51. The coupling 50 is also provided in the supply flow path 20 between the head tank e1 and the tri-directional valve 51. FIG. 10 shows a sensor filler 60, an ink full detection sensor 61, and an ink empty detection sensor 62. The bypass supply flow path 25 and the flow path which connects each head are coupled using flow paths (tubes, etc.), all of which have the same thickness.

This ink supply system is arranged to be serially connected in which each recording head (head module) is serially connected and is provided with the bypass supply flow path which bypasses the line head. Ink within the ink cartridge 3*a* is supplied first to the uppermost stream head tank a1 via the sub tank 2*a* by the supply flow path 20 and then supplied to the head tanks b1, c1, d1, and e1 in a serially-connected order. A pressure loss of ink supply becomes larger toward the downstream side, so that the bypass supply flow path 25 is connected to the lowermost stream head tank e1, thereby demonstrating a function of aiding ink supply.

An ink flow path between the heads (head modules) at least is made of a non-rigid material such as a tube, etc., for example, and a connecting unit (the coupling 50) which can be separated from a coupling of the ink flow path such that each head (head module) can be replaced is provided. While this connecting unit is arranged to be able to cut off the flow path at the time of separating and to separate the coupling 50 even when ink is loaded, an appropriate configuration can be adopted for the connecting unit. The head (head module) after separating the flow path can be replaced, etc.

Figure 11:
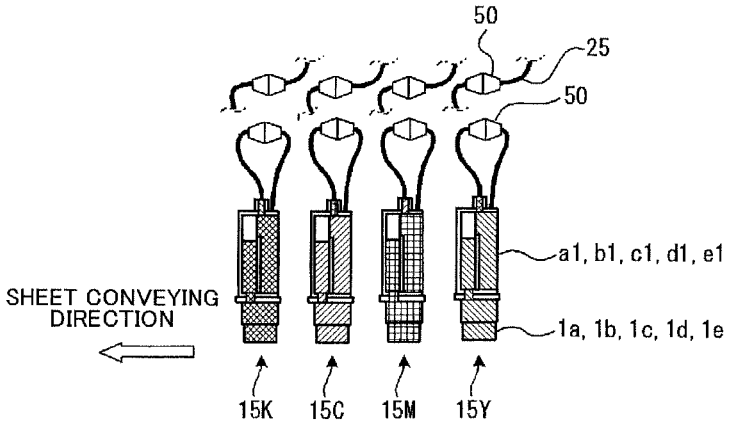
FIG. 11 is a view in a main scanning direction of a four-line (four-column) line head which is configured using the above-mentioned ink supply system.

FIG. 11 is a view in a main scanning direction (a direction orthogonal to a sheet conveying direction) of a four-line (four-column) line head (15K, 15C, 15M, 15Y) which is configured using the ink supply system shown in FIG. 10. It is seen that five recording heads (1*a*, 1*b*, 1*c*, 1*d*, 1*e*) and head tanks (a1, b1, c1, d1, e1) are lined up in the main scanning direction to configure a one-line line head 15 and, moreover, four line heads 15 (15K, 15C, 15M, 15Y) are lined up in a sub-scanning direction (the sheet conveying direction) to configure a head unit. When one head is to be replaced, one head module is to be pulled out in an upward direction shown to perform head replacement.

Figure 12A:
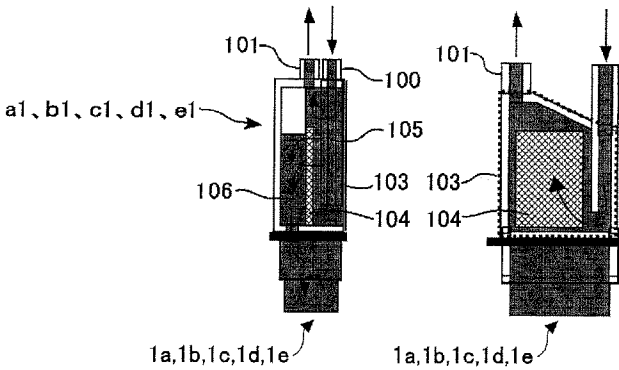
FIGS. 12A and 12B are cross sectional diagrams illustrating an internal configuration of the head tank illustrated in FIGS. 10 and 11.
Figure 12B:
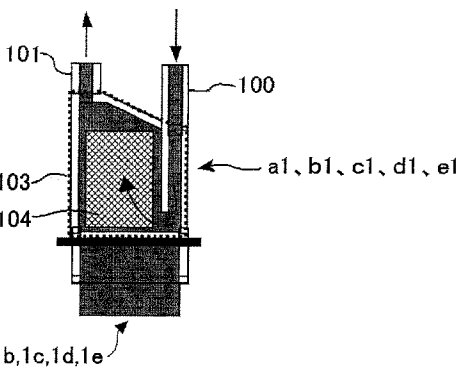

FIGS. 12A and 12B are cross sectional views showing an internal structure of the head tank shown in FIGS. 10 and 11, where FIG. 12A is a view in the main scanning direction and FIG. 12B is a view in the sub-scanning direction.

The head tank mainly includes a supply port 100, a discharge port 101, a filter 104, a film 103, etc. When viewed in the main scanning direction, there is mainly a division of left and right liquid chambers 105 and 106 within the head tank, and the filter 104 is arranged between the left liquid chamber 106 and the right liquid chamber 105.

The right liquid chamber 105 is on the upstream side of the filter in an ink flow, the left liquid chamber 106 is on the downstream side of the filter in the ink flow, and movement of ink from the upstream side liquid chamber 105 to the downstream side liquid chamber 106 passes through the filter 104.

Ink which moves to the left liquid chamber 106 on the downstream side of the filter is sent to the head (1*a*, 1*b*, 1*c*, 1*d*, 1*e*).

Moreover, ink entering the right liquid chamber 105 on the upstream side of the filter of the head tank from the supply port 100 may either be sent to the discharge port 101 or passes through the filter 104 as described above, and ink sent to the discharge port 101 is sent to an adjacent head on the downstream side.

An ink flow is communicatively connected at the right liquid chamber 105 on the upstream side of the filter within the head tank, making it possible to supply ink to the following head while suppressing flow path resistance as much as possible.

On one face of the right liquid chamber 105 on the upstream side of the filter of the head tank (a1, b1, c1, d1, e1) is adhered a flexible film 103, which is provided with a role of absorbing pressure fluctuation produced by ON/OFF of the ink flow (a damper function which absorbs the pressure fluctuation).

With this head tank, a diameter (an inner diameter) for the supply port 100 and the discharge port 101 is the same, so that no difference is provided. Moreover, as described above, the bypass supply flow path 25 and the flow path connecting each head (the discharge port 101 and the supply port 100 of the head tank) are coupled using flow paths (a tube, etc.), all of which have the same thickness.

Next, a difference in flow of air bubbles due to a path thickness (a flow path diameter) is described with reference to FIGS. 2A to 2C. As described above, a flow path such as a tube, etc., is connected to each port of the head tank. In the present specification, "the path thickness" refers to an inner diameter of a port itself and a tube, etc. (a flow path) connected to the port.

Figure 2A:
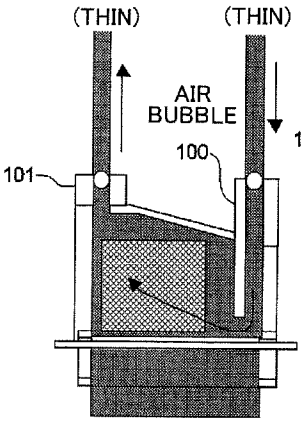
FIGS. 2A to 2C are diagrams for describing a difference in flow of air bubbles due to a thickness of a path.
Figure 2B:
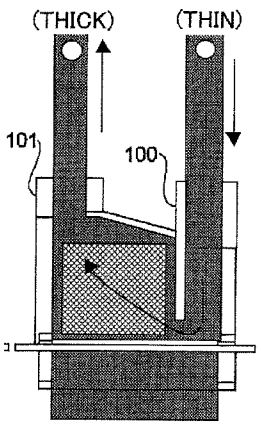

FIG. 2A shows a form of a path used in the ink supply system shown in FIGS. 12A and 12B. Generally, viscosity of ink is 3 to 16 mPa·s, at which viscosity, an inner diameter $\phi$ with which meniscus may be formed and held is less than or equal to 3, so that an inner diameter $\phi$ of the flow path and the connecting supply flow path within the head tank is set to 3 mm. In this way, at a time of initial loading or at a time of discharging air bubbles after replacing one head, air bubbles are sent into the head tank via a supply port in a vertical downward direction that connects to the head tank, facilitating sending of the air bubbles into an adjacent head tank at any time (it is difficult fpr the air bubbles to rise). However, in the line engine, multiple heads are used, so that a path length becomes longer; moreover, a path thickness c is small at 3 mm, so that fluid resistance is high and a pressure loss becomes higher, possibly causing an inability to eject stably.

FIG. 28 shows a form with a path being set to be thick ($\phi$ of greater than or equal to 3.5) in order to ease the fluid resistance. In this case, the fluid resistance becomes less; however, the path is thick, so that it is difficult for the meniscus to be formed, making it difficult to send air bubbles in a vertically downward direction (difficult for the bubbles to fall).

Figure 2C:
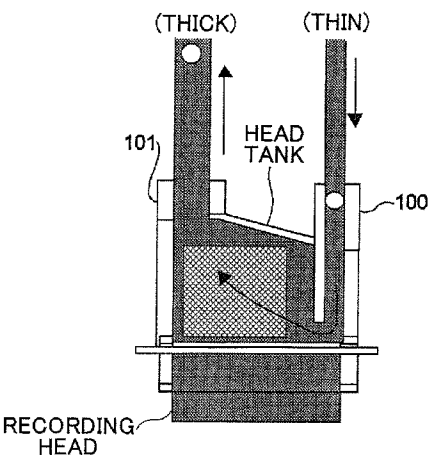

FIG. 2C shows a form of a path used in the embodiment of the present invention. The supply port 100 of the head tank is thin (inner diameter ϕ of 3 mm), while the discharge port 101 is thick (inner diameter ϕ of greater than or equal to 3.5 mm). As a matter of course, a flow path diameter connected to each port corresponds to a diameter of the port. Varying thicknesses of the paths in this way causes meniscus to be formed to facilitate the sending of air bubbles on the supply port side (in a vertically downward direction) and to facilitate air bubbles to rise on the discharge port side (in a vertically upward direction). The fluid resistance becomes high than that in the configuration in FIG. 2B, but is eased relative to that in the form in FIG. 2A.

Figure 3:
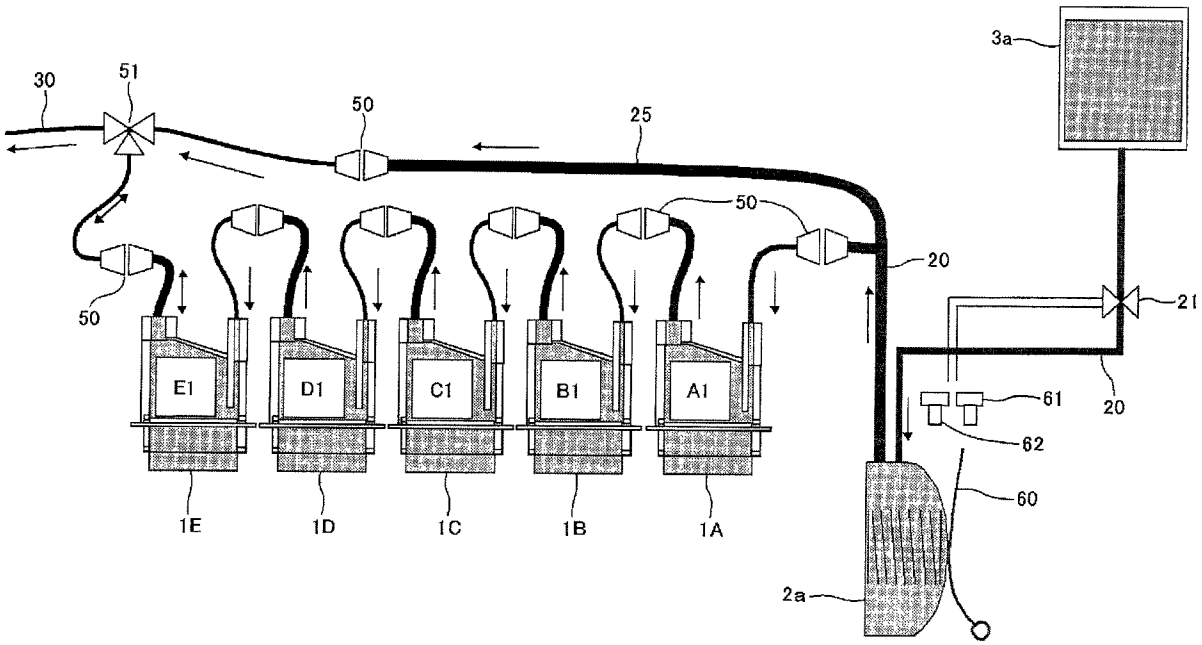
FIG. 3 is a diagram illustrating a configuration of an ink supply system in the image forming apparatus in FIG. 1.

Next, a configuration of the ink supply system in the inkjet image forming apparatus in FIG. 1 that is an embodiment of the present invention is described with reference to FIG. 3. The configurations of systems which supply ink to each line and each line head of four lines (four columns) included in the apparatus in FIG. 1 are the same, so that only one line of the four lines (four columns) are shown in FIG. 3. The difference with the ink supply system described in FIG. 10 is that path thicknesses differ on the supply side and the on the discharge side of the head tanks A1, B1, C1, D1, and E1 as described above in the embodiment (The thickness differs over the coupling 50.) Explanations which repeat those for the ink supply system described in FIG. 10 are omitted.

As also shown in FIG. 3, in the present embodiment, the supply port and the discharge port of the head tank attached to the recording head have a thin path on the supply side and a thick path on the discharge side. In the examples, the inner diameter ϕ of the path is set to less than or equal to 3 mm on the supply port 100 side and to greater than or equal to 3.5 mm on the discharge port 101 side (both up to the coupling 50). Moreover, for the bypass supply flow path 25, the inner diameter ϕ of the path up to the coupling 50 in the middle is set to be greater than or equal to 3.5 mm and the inner diameter ϕ of the path from the coupling 50 in the middle to the tri-directional valve 51 is set to be less than or equal to 3 mm. Moreover, the inner diameter ϕ of the path between the tri-directional valve 51 and the head tank e1 and the waste liquid flow path 30 downstream of the tri-directional valve 51 is also set to less than or equal to 3 mm.

Such a configuration makes it possible to facilitate sending air bubbles into the head tank to discharge the air bubbles from the head tank. Moreover, at the time of initial loading, air within the sub tank 2*a*, which is pushed by ink sent from the main tank 3*a* side, may also be discharged efficiently, making it possible to effectively discharge air bubbles to the waste liquid flow path 30 via an adjacent head tank.

(Due to switching of the tri-directional valve 51,) a flow between the tri-directional valve 51 and the head tank e1 at the time of initial loading takes an upward direction from the head tank e1 to the tri-directional valve 51. Moreover, at the time of normal printing (at the time of normal ink supply operation), as the tri-directional valve 51 is switched to stop the waste liquid flow path 30 side, ink is supplied to the head tank e1 also from the bypass supply flow path 25, so that a flow between the head tank e1 and the tri-directional valve 51 takes a downward direction from the tri-directional valve 51 to the head tank e1.

FIG. 3 shows a state in which ink is loaded in the sub-tank, the recording head, and the supply flow path. The ink flows such that it is sent from the ink cartridge 3*a* to the sub tank 2*a*, from the sub tank 2*a* to an uppermost stream head tank A1, and supplied in the order of head tanks B1, C1, D1, and E1 on the downstream side. Moreover, as described above, ink can be supplied to the head tank E1 also from the bypass supply flow path 25.

When replacement of the recording head is necessary, a coupling 50 installed in a flow path between heads (head modules) can be separated to replace only a target head (head module).

At the time of a normal ink supply operation, a bulge of a film face of the sub tank 2*a* is amplified with a sensor filler 60 and an amplitude of the sensor filler 60 is detected with the ink empty detection sensor 62 and the ink full detection sensor 61 to suitably control the ink amount within a sub tank 2*a*.

When the ink empty detection sensor 62 detects the filler, an ink supply valve 21 is opened to supply ink from the ink cartridge 3*a*, while, when the ink full detection sensor 61 detects the filler, the ink supply valve 21 is closed to stop ink supply.

Figure 4:
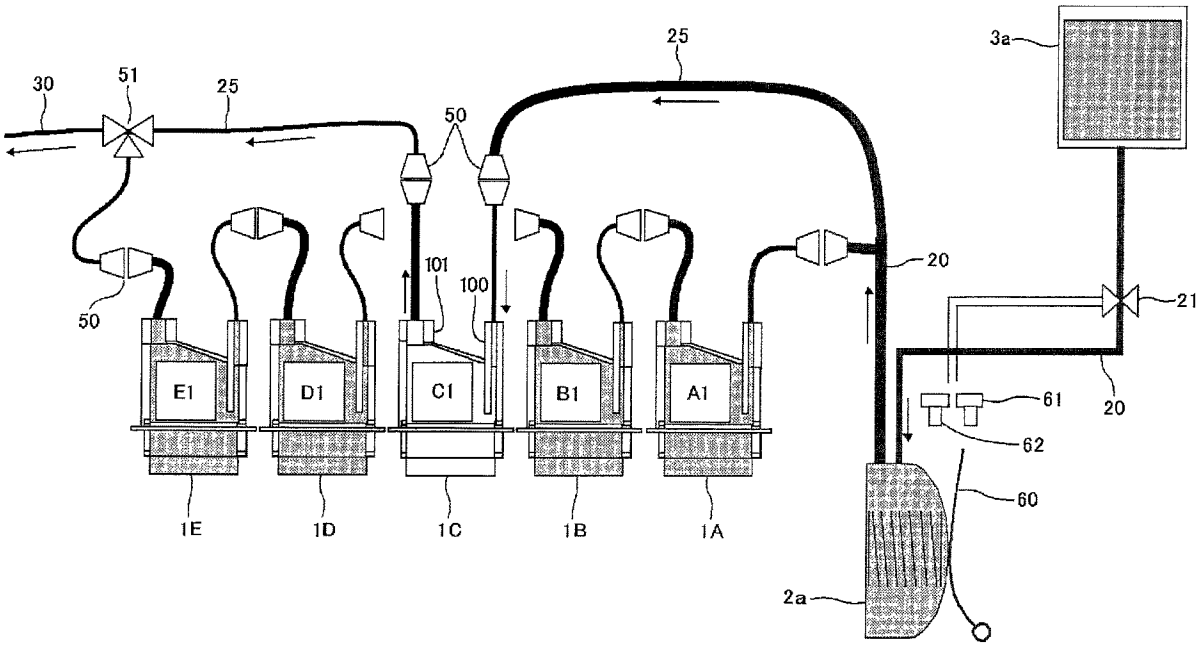
FIG. 4 is a diagram illustrating a connection state of a flow path at the time of ink loading after head replacement.

FIG. 4 is a diagram illustrating a connection state of a flow path when ink is loaded after head replacement; While a case is described here of replacing a center head module (a head 1C, a head tank C1) of head modules lined up in a multiple number (five in the present example) in the main scanning direction, the same applies when a different head module is replaced.

In FIG. 4 is shown a state in which a new head module is set at a predetermined position of the line head 15 and ink is not loaded in the head 1C and the head tank C1. When the head module is replaced, the coupling 50 of the bypass supply flow path 25 is separated to connect to a coupling of the head module replaced.

The upstream side (the sub tank 2*a* side) of the bypass supply flow path 25 which is separated, is connected to the supply port 100 of the head tank C1, while the downstream side (the waste liquid flow path 30 side) of the bypass supply flow path 25 is connected to the discharge port 101 of the head tank C1.

At the time of normal ink supply, the tri-directional valve 51 installed between the bypass supply flow path 25 and the waste liquid flow path 30 is switched such that there is a communicative communication from the bypass supply flow path 25 to the head tank E1, while at the time of loading ink into the replaced head (in the state in FIG. 4), it is switched such that there is a communicative communication between the bypass supply flow path 25 and the waste liquid flow path 30.

When loading ink to the head 1C and the head tank C1, the ink supply valve 21 is opened while pressurizing the ink cartridge 3*a* by a pressurizing apparatus (not shown) to send ink within the ink cartridge 3*a* to the sub tank 2*a*, and the ink is supplied to the head 1C and the head tank C1 when the sub tank 2*a* becomes full.

At this time, while ink supplied from the sub tank 2*a* is supplied in a slight amount also to the head 1A, inside the replaced head tank C1 and the head 1C is open to atmosphere via the tri-directional valve 51 and the waste liquid flow path 30, so that most of the ink is supplied to the head tank C1.

When ink is supplied for a predetermined time period from the sub tank 2*a*, the ink supply valve 21 is closed to stop ink supply. After loading ink, the coupling 50 of the supply path of the head tank C1 is reconnected to a state shown in FIG. 3 and the coupling 50 of the bypass supply flow path 25 is also reconnected to connect the upstream side and the downstream side to provide a normal print state.

Ink which drips down from the respective heads 1A, 1B, and 1C at the time of loading the ink is caught and suctioned by a suction cap (not shown) arranged at a lower portion of a nozzle of a head. Moreover, in order to load the ink in every corner of a liquid chamber within the respective heads (1A, 1B, 1C, 1D, 1E), the ink is suctioned from the head nozzle by the above-mentioned suction cap.

Such a configuration makes it possible to efficiently discharge air bubbles within the head tank to the waste liquid flow path 30, being pushed by the ink sent from the main tank (the ink cartridge 3*a*) side at the time of replacing one head.

Figure 5A:
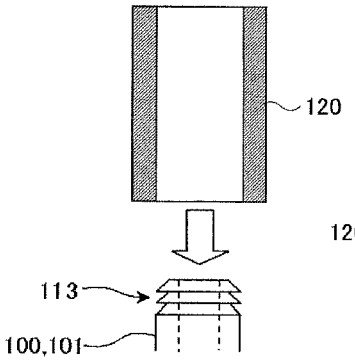
FIGS. 5A and 5B are diagrams illustrating a retaining structure of the flow path that is provided at a port of a head tank.
Figure 5B:
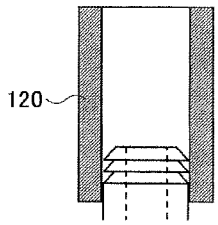

At a tip of the discharge port 101 and the supply port 100 of the respective head tanks (A1, B1, C1, D1, E1) is formed a bamboo-shaped boss portion 113 as shown in FIG. 5, into which boss portion 113, a flow path 120 such as a flexible tube, etc., is pushed to connect the flow path 120 to the ports 100 and 101 as shown in FIG. 5B. The boss portion 113 at the port tip makes it difficult for the flow path 120 such as the tube, etc., to come out. FIG. 5 provides an illustration which does not take into account a difference in the thickness of paths (ports and flow paths). Moreover, the flow path 120 may be a flow path which connects the respective head tanks, or a flow path which connects the subtank 2*a* side and an uppermost stream head tank A1, or a flow path which connects the tri-directional valve 51 and a lowermost stream head tank E1.

Figure 6A:
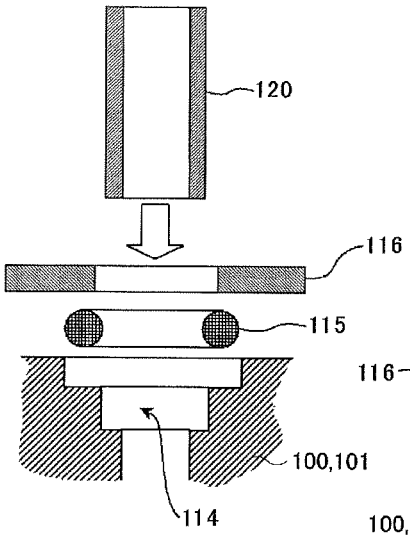
FIGS. 6A and 6B are diagrams illustrating a different configuration example of the retaining structure of the flow path.
Figure 6B:
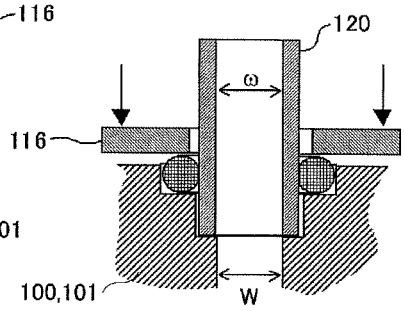

FIGS. 6A and 6B show another exemplary configuration of a connecting part between the flow path and the supply port 100 or the discharge port 101 of the respective head tanks (A1, B1, C1, D1, E1). FIGS. 6A and 6B also provide an illustration which does not take into account a difference in the thickness of paths (ports and flow paths).

In FIGS. 6A and 6B, a rubber packing 115 and a packing gland 116 are inserted into the tip of the flow path 120, connecting the tip of the flow path to the supply port 100 (the discharge port 101) of the head tank. In the supply port 100 (the discharge port 101) is formed a stepped flow path connecting part 114, on the side of an upper step of which the flow path connecting part 114 and the rubber packing 115 is fitted, and the rubber packing 115 is pressed down with the packing gland 116 from above. Then, the rubber packing 115 and the packing gland 116 are locked to the supply port 100 (the discharge port 101) with a lock unit (not shown) such as a screw, a hook, etc. The rubber packing 115 which is pressed down with the packing gland 116 is caused to adhere to the supply port 100 (the discharge port 101) and the flow path 120, thereby ensuring retention of the flow path 120 such as a tube, etc., as well as ensuring sealing of leakage of fluid from within the head tank. Moreover, the present configuration may make the inner diameter W of the port and the inner diameter w of the flow path the same diameter, making it possible to decrease the fluid resistance.

Figure 7:
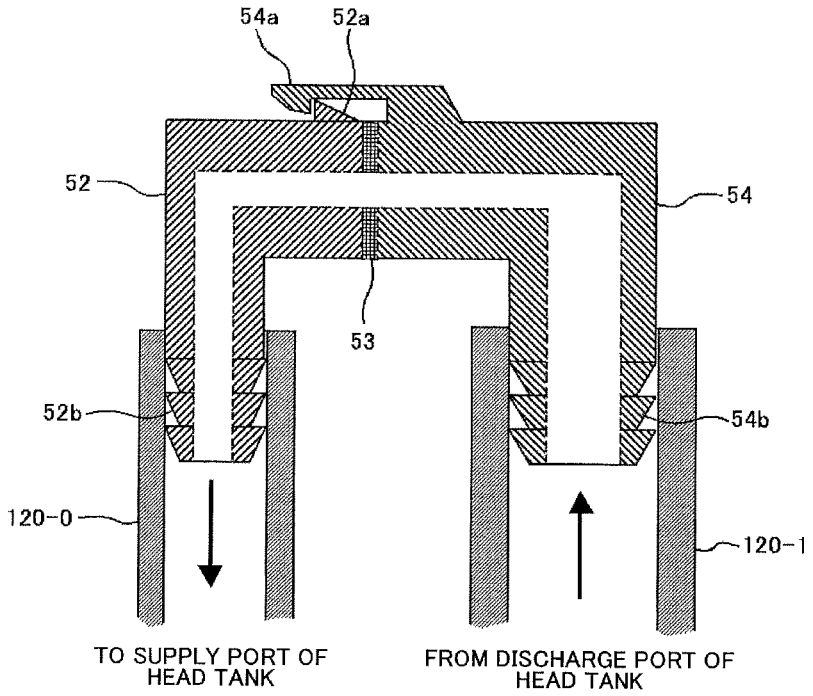
FIG. 7 is a diagram illustrating a configuration example of a coupling unit used in coupling the flow path.

FIG. 7 shows a configuration example of the coupling 50 as a coupling unit used in coupling the flow path.

As described above, in the present embodiment, the supply port 100 and the discharge port 101 of the respective head tanks (A1, B1, C1, D1, E1) mutually differ in the port diameters (thin on the supply side and thick on the discharge side). Therefore, for the flow path such as the tube, etc., that is connected to the supply port and the flow path such as the tube, etc., that is connected to the discharge port 101, the inner diameters differ. In this way, in order to connect the flow paths with mutually different inner diameters, the coupling 50 which is configured as shown in FIG. 7 is used.

In other words, the coupling 50 in FIG. 7 includes a coupling 52 on the supply port side, a packing 53, and a coupling 54 on the discharge port side, and the two couplings 52 and 54 are connected via the packing 53. The coupling 54 on the discharge port side has an inner diameter thereof varying at a bent portion in the middle. In other words, the inner diameter on the upstream side of the bent portion (on the side on which the tube, etc., are connected) is thick (ϕ of greater than or equal to 3.5) and the inner diameter on the downstream side of the bent portion (on the side coupled to the coupling 52 on the supply port side) is thin (c of less than or equal to 3).

Moreover, in the coupling 52 on the supply port side is formed a lock part 52*a* with a triangular cross section, and in the coupling 54 on the discharge port side is formed a coupling hook 54*a* which is arranged to lock to the lock part 52*a* on the supply side. While it is shown that the lock part 52*a* and the coupling 54 are provided only on one side (the upper side), it may be arranged to provide them also on the lower side. When making the connection, the coupling 52 on the supply port side and the coupling 54 on the discharge port side are pressure welded with the packing 53 placed therebetween and the coupling hook 54*a* is locked to the lock part 52*a* to cause the coupling 52 on the supply port side and the coupling 54 on the discharge port side to be coupled. In addition to the example illustrated, a coupling unit of an appropriate scheme such as sandwiching with a screw or a different member, or a rotating-type coupling member may be used.

As shown, on the supply port 52*b* side is formed a bamboo-shaped boss part 52*b* so as to make it possible for a thin supply flow path (ϕ of less than or equal to 3) to be connected thereto. Moreover, on the discharge port side is formed a bamboo-shaped boss part 54*b* so as to make it possible for a thick supply flow path (ϕ of greater than or equal to 3.5) to be connected thereto. The bamboo-shaped boss parts 52*b* and 54*b* make it difficult for the flow path 120 to come out. The flow path 120-0 is to be connected to the supply port 100 of the head tank, while the flow path 120-1 is to be connected to the discharge port 101 of the head tank. In this way, the diameter may be made larger on the discharge port side than that on the supply port side to more efficiently discharge air bubbles.

Figure 8:
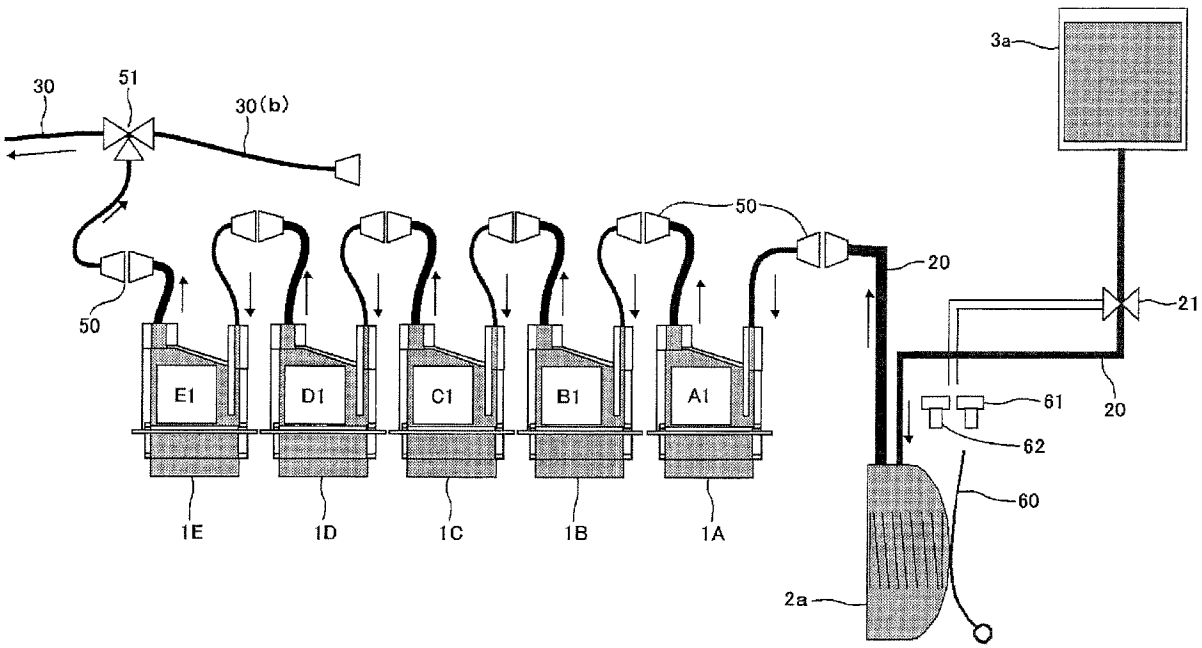
FIG. 8 is a diagram illustrating a second embodiment of the ink supply system.

FIG. 8 is a diagram illustrating a second embodiment of the ink supply system. The same letters are given to parts which are identical or equivalent to those in the ink supply system according to the first embodiment described in FIG. 3 and repeated explanations are omitted, so explanations are provided only for the different parts.

In the second embodiment shown in FIG. 8, what is different from the first embodiment is that there is no bypass supply flow path 25 which connects the sub tank 2*a* to the head tank e1. Moreover, the waste liquid flow path 30(*b*) is connected also on the right side of the tri-directional valve 51, and a coupling is provided to a tip thereof in a free state.

Compared to the related art configuration described in FIG. 10, the path is made thick on the discharge side of the head tank to make the fluid resistance less, so that a stable ejection is possible even without the bypass supply flow path 25.

In FIG. 8, the tri-directional valve 51 is in a state such that the flow path on the head tank e1 side is communicatively connected to the waste liquid flow path 30 on the discharge side (the left side shown) and is cut off from the waste liquid flow path 30(*b*). Moreover, it shows a state such that ink is loaded within the head tank, the head, and the supply flow path. This state is a state in which print is normally possible.

The ink flows such that it is sent from the ink cartridge 3*a* to the sub tank 2*a*, from the sub tank 2*a* to a head 1A on the upstream side and supplied in the order of heads 1B, 1C, 1D, and 1E on the downstream side.

A supply flow path is connected between adjacent heads and the coupling 50 is installed in the supply flow path in the same manner as in the first embodiment. The coupling 50 can separate (put on and take off) the supply flow path while the ink is loaded in the supply flow path.

In such a configuration, it suffices to have a smaller number of units of usage of the coupling 50 compared to that in the first embodiment, making it possible to further decrease component costs. Moreover, it may facilitate sending air bubbles into the head tank and discharging the air bubbles from the head tank. Furthermore, at the time of initial loading, air within the sub tank 2*a*, which is pushed by ink sent from the main tank (the ink cartridge 3*a*) side, may also be discharged efficiently, making it possible to efficiently discharge air bubbles to the waste liquid flow path 30 via an adjacent head tank.

Figure 9:
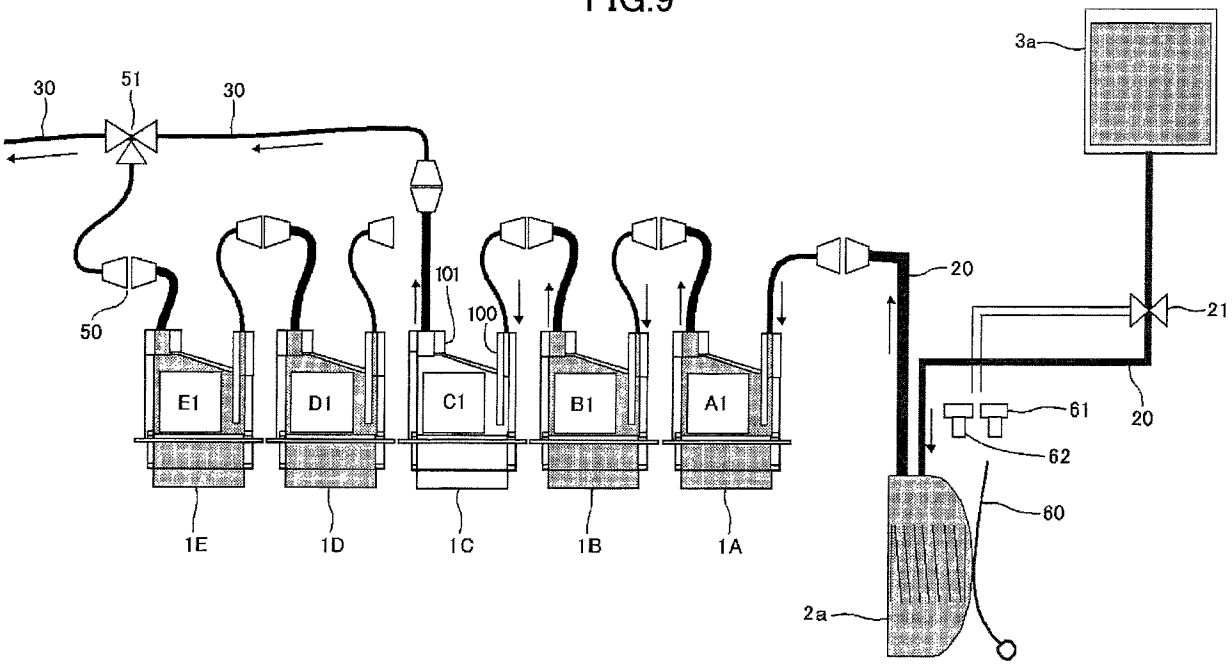
FIG. 9 is a diagram illustrating a connection state at the time of ink loading after head replacement in the ink supply system in the second embodiment.

FIG. 9 illustrates a connection state at the time of ink loading after head replacement in the ink supply system in the second embodiment. While a case is described here of replacing a center head module (a head module C which includes the head 1C and the head tank C1), the same applies to a case of replacing a different head module.

In FIG. 9 is shown a state in which a new head module is set at a predetermined position of a line head and ink is not loaded in the head 1C and the head tank C1. When the head module is replaced, the supply port 100 of the head tank C1 is connected to a coupling of the head tank B1 on the upstream side as in an original state, and the discharge port 101 is connected to a coupling 50 which is installed at one end of the waste liquid flow path 30(*b*). The tri-directional valve 51 is in a state in which the head tank C1 and the waste liquid flow path 30 are open to the atmosphere.

When loading ink to the head 1C and the head tank C1, in the same manner as the first embodiment, the ink supply valve 21 is opened while pressurizing the ink cartridge 3*a* by the pressurizing apparatus not shown to send ink within the ink cartridge 3*a* to the sub tank 2*a*, and the ink is supplied to the head tank A1 when the sub tank 2*a* becomes full.

The ink is supplied in the order of the head tank A1, B1, and C1. As the discharge port 101 of the head tank C1 is open to the atmosphere via the waste liquid flow path 30, when the ink is sent into the head tank C1, air bubbles within the head tank C1 are discharged to outside the apparatus via the waste liquid flow path 30, so that loading of the ink into the head tank C1 is easy.

When ink is supplied for a predetermined time period from the sub tank 2*a*, the ink supply valve 21 is closed to stop ink supply.

After loading the ink, the coupling of the supply flow path of the head tank C1 turns to a normal print state, reconnecting to the state shown in FIG. 8.

Ink which drips down from nozzles of the respective heads 1A, 1B, and 1C at the time of loading the ink is caught and suctioned by a suction cap (not shown) arranged at a lower portion of the nozzle of the head. Moreover, in order to load the ink in every corner of the liquid chamber within the head, the ink is suctioned from the head nozzle by the suction cap.

The present configuration in the second embodiment makes it possible to efficiently discharge air bubbles within the head tank to the waste liquid flow path 30, being pushed by the ink sent from the main tank (the ink cartridge 3*a*) side at the time of replacing one head.

In this way, in the present invention, the head tank mounted on the head of the line engine in which multiple recording heads are lined up in a main scanning direction has an inner diameter of a path on the discharge port side larger that an inner diameter of a path on the supply port side, making it possible to discharge air bubbles within the head tank efficiently and speedily with a small amount of passing liquid after replacing one head or at the time of initial loading and decreasing the fluid resistance in the ink flow path up to the recording head and decreasing the pressure loss to perform a stable ink ejection.

Moreover, the second supply path which connects the sub tank and the recording head on the lowermost stream side may be connected to demonstrate a function of aiding ink supply.

Furthermore, the path on the supply port side is set to have an inner diameter which makes it possible for ink to form and hold meniscus and the path on the discharge port side is set to have an inner diameter in which rising of air bubbles is easy, facilitating sending of the air bubbles on the supply side and facilitating rising of the air bubbles on the discharge side, making it possible to efficiently discharge the air bubbles.

Moreover, the waste liquid flow path is connected to the second supply flow path via a tri-directional switching valve, making it possible to switch aiding of ink supply and discharging of waste ink and air bubbles.

Furthermore, a flow path which includes a coupling unit at a tip thereof to make it possible to couple to a discharge port of each recording head and a waste liquid flow path are connected via the tri-directional switching valve to a discharge port of the recording head on the lowermost stream side, making it possible to couple the waste liquid flow path to the discharge port of the recording head at the time of replacing the head and to certainly and speedily discharge the air bubbles.

Moreover, when replacing the recording head, the waste liquid flow path is provided such that it can connect to the discharge port of the replaced recording head, making it possible to couple the waste liquid flow path to the discharge port of the recording head and to certainly and speedily discharge the air bubbles at the time of replacing the head.

Next, the second embodiment is described which adopts a joint configuration which may prevent ink dripping and ink leakage at the time of recording head replacement.

Figure 13A:
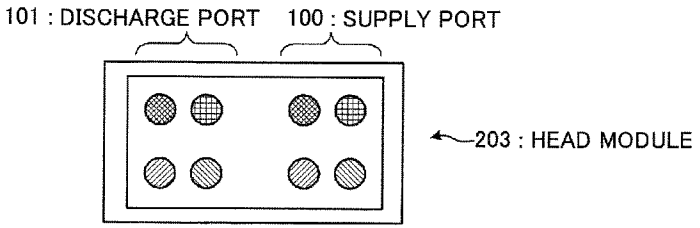
FIGS. 13A to 13C are three face views illustrating one example of a recording head which may eject multiple colors.
Figure 13B:
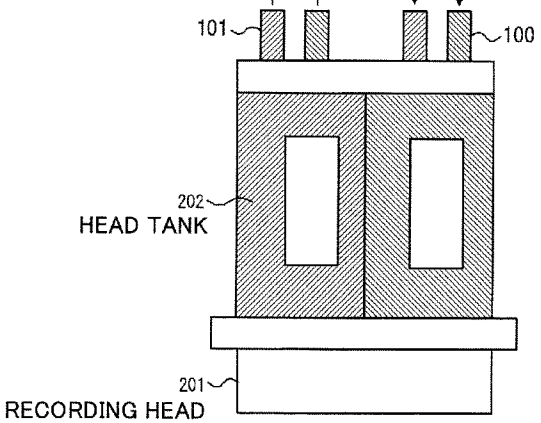
Figure 13C:
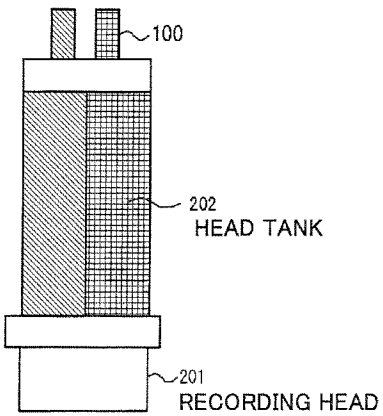

The recording head includes a recording head which is configured to be able to eject multiple colors with one head with multiple nozzle columns provided. FIGS. 13A, 13B, and 13C are three face views illustrating one example of the recording head having such a configuration.

FIG. 13A is a top view of a head module which includes a recording head and a head tank. Moreover, FIG. 13B is a side view in which the head module is viewed from a position with a larger width (a sub-scanning direction), while FIG. 13C is a side view in which the head module is viewed from a position with a smaller width (a main scanning direction).

Figure 14:
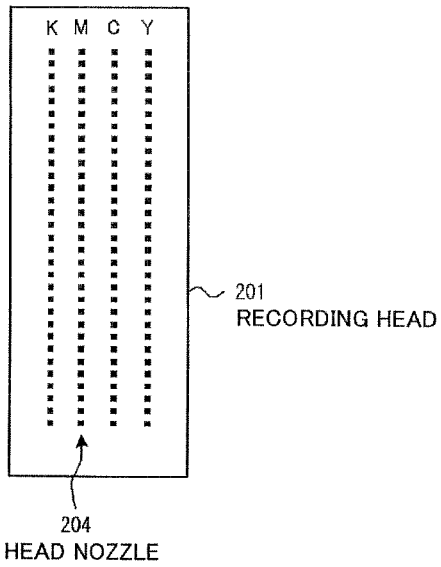
FIG. 14 is a diagram illustrating nozzle sequences of the above-mentioned recording head.

In a head module 203 shown, a head tank 202 which is divided into multiple chambers is installed at an upper portion of a recording head 201, and a supply port 100 which supplies ink to each chamber and a discharge port 101 which discharges ink from each chamber are provided at an upper portion of the head tank 202. In the example shown, as shown in FIG. 14, the recording head 201 has nozzle columns 204 of four colors of K (black), M (magenta), C (cyan), and Y (yellow), so that a port at an upper portion of the module includes four of the supply ports 100 and four of the discharge ports 101. In the line engine, a line head is formed by respectively connecting these four ports by a tube and a joint to connect the head (head module 203). While an example of the number of colors of four is shown, the number of colors may be two, three, six, etc.

Figure 15:
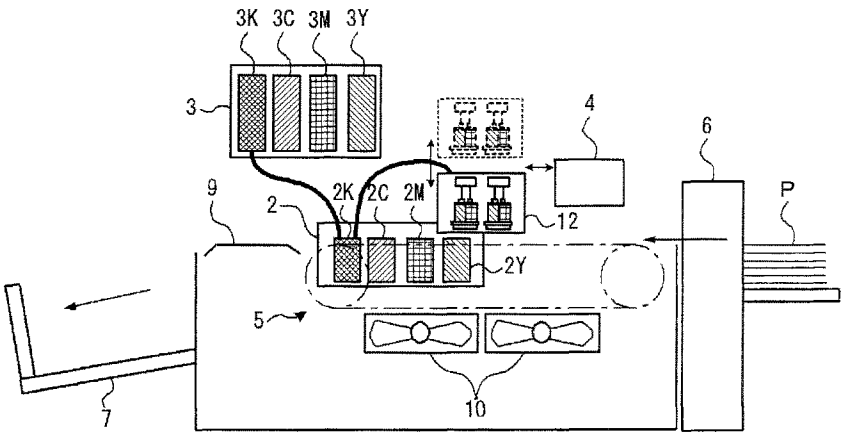
FIG. 15 is a schematic configuration diagram illustrating the image forming apparatus of the second embodiment.

FIG. 15 is a configuration diagram showing a schematic configuration in one example of a line inkjet image forming apparatus which uses the recording head (the head module 203) described in FIGS. 13A, 13B, 13C, and 14. Basically the basic configuration is the same as that in FIG. 1 except that the configuration of the recording head and the line head by means of the recording head is different, so that repeated explanations are omitted.

Figure 16:
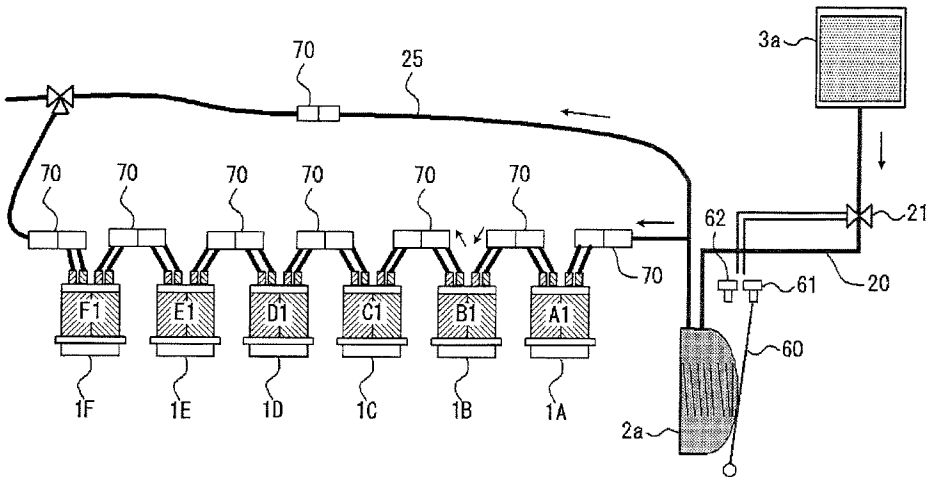
FIG. 16 is a diagram illustrating the ink supply system in a line head using the recording head in FIGS. 13A to 13C.

FIG. 16 is a diagram showing an ink supply system in a line head in which the recording head (the head module 203) described in FIGS. 13A, 13B, 13C, and 14 where a multiple number (six in the example shown) are connected. As described above, the recording head (head module 203) which is configured as described above includes the supply port 100 and the discharge port 101 for each color of K, M, C, and Y; In order to avoid complexity of the figure, only one is shown respectively for the main tank (ink cartridge) 3*a* and the sub tank 2*a*. Moreover, an ink tube which connects each element is not shown for each color, but only one or two thereof is shown.

While the ink supply system in FIG. 16, which is basically the same as the ink supply system in FIG. 3, is different from the ink supply system in FIG. 3 in that the configuration of the recording head (head module 203) is different and a joint 70 and not a coupling 50 is used to make it possible to separate and connect each recording head (head module 203).

While the thicknesses (inner diameters) of the tubes and the ports are shown to be the same in FIG. 16, the inner diameter of the path on the discharge port side of the head tank is arranged to be larger than the inner diameter of the path on the supply port side of the head tank as in the first embodiment. Moreover, the thickness (inner diameter) of the tube also corresponds to each port, so that the thickness of the tube for each part is the same as that of the corresponding part in the ink supply system in FIG. 3.

While the coupling 50 according to the above-described first embodiment connects and separates one tube (corresponding to one color), the joint 70 used in the second embodiment connects and separates multiple tubes (corresponding to multiple colors). Here, an example with four colors is shown for the recording head (head module 203), so that explanations are given with the joint 70 also connecting and separating four tubes (four colors). The configuration corresponding to two colors, three colors, six colors, etc., is also possible.

Figure 17:
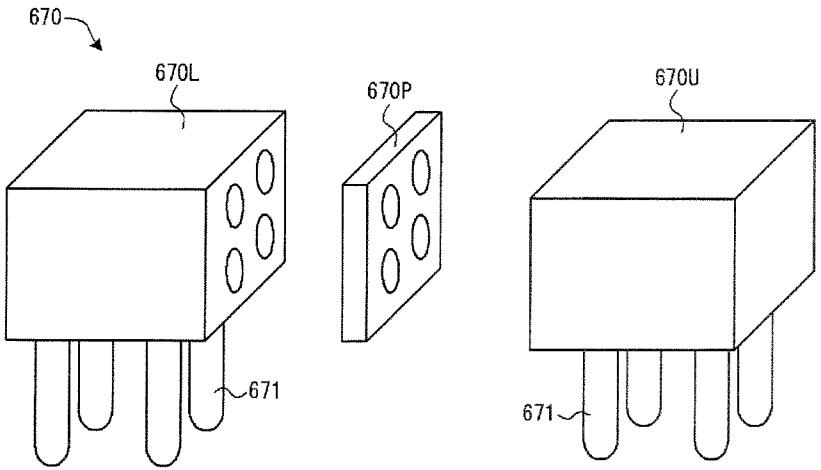
FIG. 17 is a perspective view illustrating one example of a related-art joint configuration.
Figure 18:
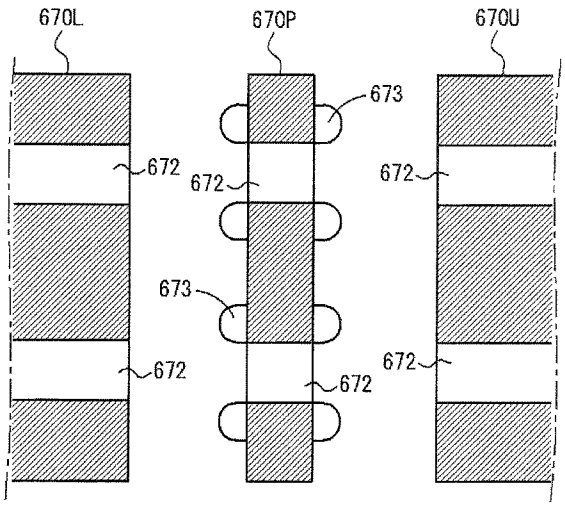
FIG. 18 is a cross sectional diagram of the above-mentioned joint configuration.

Here, an example of a related art joint configuration is explained using FIGS. 17 and 18 for comparison with embodiments of the present invention.

In FIGS. 17 and 18, a joint 670 includes a joint on the upstream side 670U, a joint on the downstream side 670L, and a packing 670P. Four paths (ink flow paths) are formed in the joint and the joint on the upstream side 670U and the joint on the downstream side 670L are connected via the packing 670P. At a lower portion of the joint on the upstream side 670U and the joint on the downstream side 670L is provided a head connection port 671 in a number of paths, which head connection port 671 is arranged to connect to a supply port or a discharge port of a head tank via a tube (not shown).

In the surrounding of a hole (an ink flow path) 672 of the packing 670P (such as to surround a circumference of the hole) is formed a projection 673 with a height of about 1 mm, so that it is arranged for the joints 670U and 670L on the upstream side and on the downstream side to press the projection 673 to seal the hole of the ink flow path. The projection for sealing may be provided on the joint side, not on the packing side.

The joints 670U and 670L on the upstream side and on the downstream side are connected in the same configuration as that explained in FIG. 7 and, at the time of mounting and dismounting, a hook 54*a* is deformed within an elastic deformation to mount and dismount the joint.

With such a joint configuration, there is a problem that ink drips to cause color mixing at the time of mounting and dismounting the joint since a distance between adjacent paths (ink flow paths) located above and below or to the left and the right is small. Therefore, the present invention proposes a joint configuration which makes it possible to avoid color mixing due to dripping and leakage of the ink even when the joint is mounted and dismounted at the time of recording head replacement.

Figure 19:
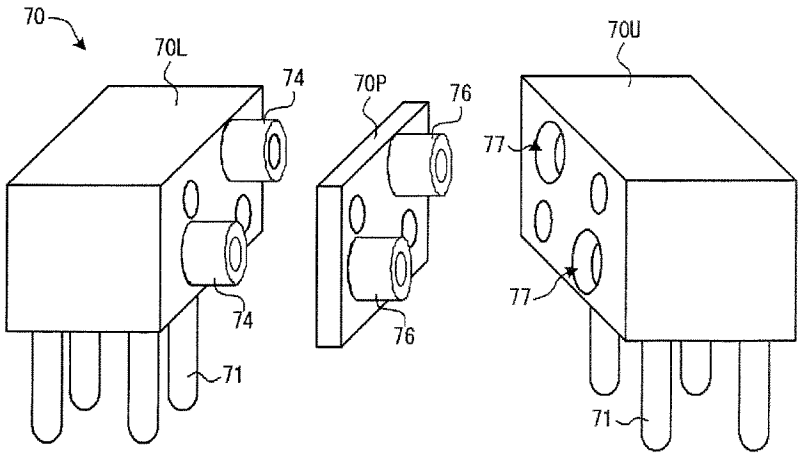
FIG. 19 is a perspective view illustrating a first embodiment of a joint configuration according to the present invention.
Figure 20:
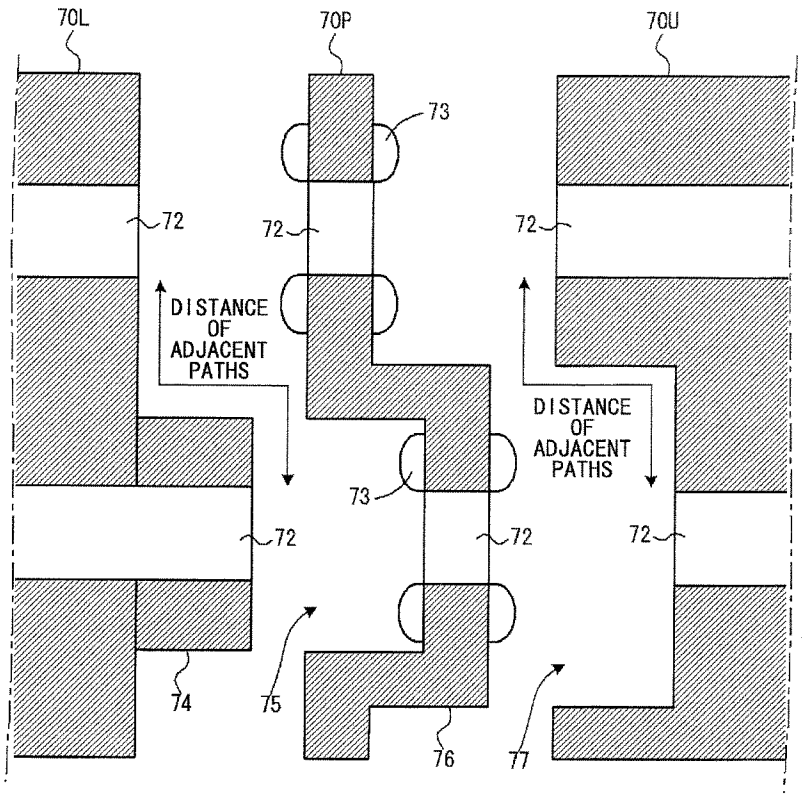
FIG. 20 is a cross sectional diagram of the above-mentioned joint configuration.

FIGS. 19 and 20 are perspective and sectional views illustrating a first embodiment of a joint configuration according to the present invention. A joint 70 according to the first embodiment is configured such that, in respective connection faces of a member on the upstream side and a member on the downstream side, adjacent ink paths have a mutually concave-convex relationship (a front and back relationship in a direction in which a flow path flows) and a convex part on the connection face on one side fits into a concave part on the other connection face on the other side.

In FIGS. 19 and 20, the joint 70 includes a joint on the upstream side 70U, a joint on the downstream side 70L, and a packing 70P. Four paths (ink flow paths) are formed in the joint and the joint on the upstream side 70U and the joint on the downstream side 70L are connected via the packing 70P. At a lower portion of the joint on the upstream side 70U and the joint on the downstream side 70L is respectively provided a head connection port 70 in a number of paths, which head connection port 71 is arranged to connect to a supply port or a discharge port of a head tank via a tube (not shown).

On the connection face of the joint on the downstream side 70L, it is arranged for adjacent ink paths to have a mutually concave-convex relationship (a front and back relationship in a direction in which a flow path flows). In other words, two diagonally located paths of four paths (ink flow paths) are projected to form fitting convex portions 74, 74. On an end face on the downstream side of the packing 70P are provided fitting concave portions 75, 75 to which fitting convex portions 74, 74 of the joint 70L are fitted (In the sectional view in FIG. 20, only one concave portion 75 is shown.)

Moreover, on an end face on the opposite side (upstream side) of the packing 70P, in the same manner as the joint 70L, two diagonally located paths are projected to form fitting convex portions 76, 76. The fitting convex portion 74 of the joint 70L fits into the fitting concave portion 75, so that an outer diameter of the fitting convex portion 76 is larger than an outer diameter of the fitting convex portion 74.

Then, also on the connection face of the joint on the upstream side 70U, it is arranged for adjacent paths to have a mutually concave-convex relationship (a front and back relationship in a direction in which a flow path flows). In other words, two diagonally located paths of four paths (ink flow paths) are depressed to form fitting concave portions 77, 77 (In the sectional view in FIG. 20, only one concave portion 77 is shown). This fitting concave portion 77, 77 is a concave portion into which the fitting convex portion 76, 76 of the packing 70P is fitted.

At the time of connecting the joint, the fitting convex portion 74 of the joint on the downstream side 70L is fitted into the fitting concave portion 75 of the packing 70P and the fitting convex portion 76 of the packing 70P is fitted into the fitting concave portion 77 of the joint on the upstream side 70U. In other words, the fitting convex portion and the fitting concave portion that are provided in the joint and the packing are fitted into each other in a nesting state.

In the surrounding of a hole (an ink flow path) 72 of the packing 70P (such as to surround a circumference of the hole) is formed a projection 73 with a height of about 1 mm, so that it is arranged for the joints 70U and 70L on the upstream side and on the downstream side to press the projection 73 to seal the hole of the ink flow path. The projection for sealing may be provided on the joint side, not on the packing side.

In this way, the joint 70 according to the present invention is configured for neighboring paths (ink flow paths) to mutually have a concave-convex relationship to make it possible to increase a distance of otherwise closest adjacent paths (ink flow paths), so as to prevent mixing of ink at the time of mounting and dismounting the joint.

While the fitting convex portion 74 is provided in the joint on the downstream side 70L and the fitting concave portion 77 is provided in the joint on the upstream side 70U in the example shown, conversely, the fitting convex portion may be provided on the upstream side and the fitting concave portion may be provided on the downstream side. In that case, the fitting concave portion 75 and the fitting convex portion 76 of the packing 70P are provided in a reverse direction.

Figure 21:
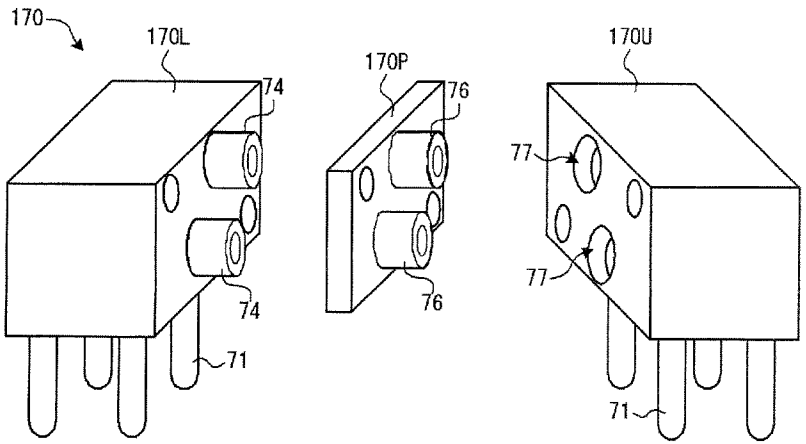
FIG. 21 is a perspective view illustrating a second embodiment of the joint configuration.
Figure 22A:
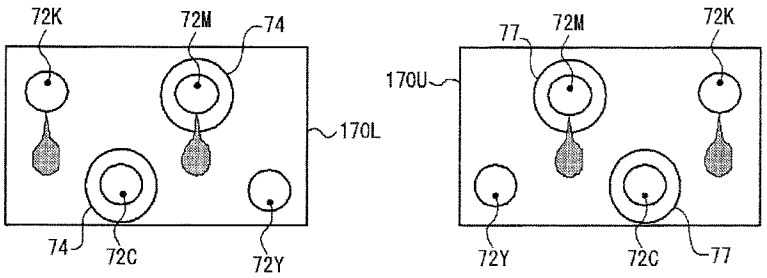
FIGS. 22A and 22B are front views showing a joint connection face and joint cross sectional diagrams.
Figure 22B:
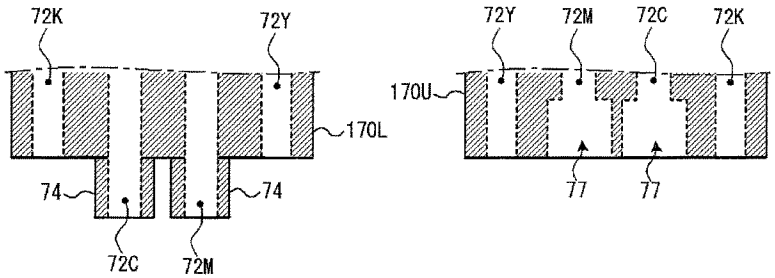

FIGS. 21, 22A, and 22B show a second embodiment of the joint configuration. FIG. 22A is a front view showing a connection face of each joint on the upstream side and on the downstream side, while FIG. 22B is a plane sectional view of each joint on the upstream side and the downstream side.

In the joint 170 according to the second embodiment, multiple ink paths (flow paths) included by the joint are arranged in a staggered fashion (in a staggered fashion in the connection face). When four paths (ink flow paths) 72 are included as in the example shown, the respective paths are arranged in a staggered fashion, so that four paths (ink flow paths) 72 are arranged in a diamond shape in the joint connection face as shown in the front view in FIG. 22A. In the same manner as in the first embodiment, two diagonally located paths are provided in a relationship of the fitting convex portion 74 and the fitting concave portion 77. According to the second embodiment, the path 72M (magenta) and the path 72C (cyan) that are diagonally located are provided as the fitting convex portion 74 and the fitting concave portion 77. A packing 170P is the same as the packing 70P according to the first embodiment, except that four paths (ink flow paths) are arranged in a diamond shape or in a staggered fashion in correspondence with the joint 170U and 170L on the upstream side and the downstream side. It is also the same that the fitting concave portion 76 and the fitting convex portion 75 (not shown) are provided on both faces of the packing and a projection 73 (not shown) with a height of about 1 mm is formed in the surrounding of the hole of the path (ink flow path).

FIG. 22A shows how ink dripping occurs in adjacent paths (72K and 72M); as described above, the four paths (ink flow paths) are arranged in a diamond shape or in a staggered fashion, and, as shown in FIG. 22B, they are separated in front and back (front and back in an ink conveying direction), making a distance of adjacent paths larger and making it possible to ensure prevention of mixing of ink at the time of mounting and dismounting the joint.

While the fitting convex portion 74 is provided in the joint on the downstream side 170L and the fitting concave portion 77 is provided in the joint on the upstream side 170U in the example shown, conversely, the fitting convex portion may be provided on the upstream side and the fitting concave portion may be provided on the downstream side. In that case, the fitting concave portion 75 and the fitting convex portion 76 of the packing 170P are provided in a reverse direction.

Moreover, while four paths (of four colors) are included in the example shown, the configuration with the number of colors of two, three, six, etc., can also be applied, so that each route may be arranged in a staggered fashion (in the staggered fashion in the joint connection face).

Figure 23:
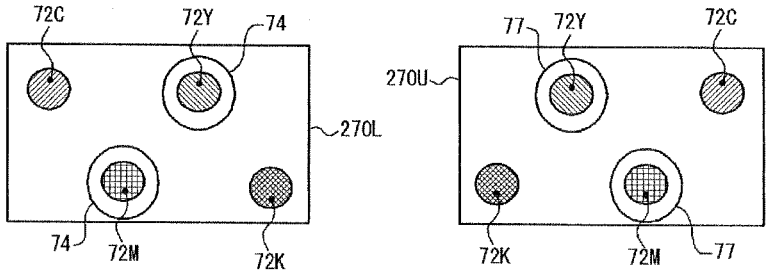
FIG. 23 is a front view of the joint connection face showing a third embodiment of the joint configuration.

FIG. 23 shows a third embodiment of the joint configuration in a front view showing a connection face of the joint on the upstream side and the joint on the downstream side.

While a joint 270 according to the third embodiment shown is configured to be the same as the joint 170 according to the second embodiment, it is arranged to use two paths (ink flow paths) on an upper step as paths for light color ink and two paths (ink flow paths) on a lower step as paths for dark color ink. In an example shown, paths 72Y and 72C of yellow and cyan are arranged on the upper step as light colors and paths 72K and 72M of black and magenta are arranged on the lower step as dark colors.

While it is configured for four paths (ink flow paths) to be arranged in a diamond shape or in a staggered fashion in the example shown, it is also possible to apply the third embodiment (with use of an upper step as a path for a light color ink and a lower step as a path for a dark color ink) in a configuration according to the first embodiment as described in FIGS. 19 and 20.

Moreover, while the fitting convex portion 74 is provided in the joint on the downstream side 270L and the fitting concave portion 77 is provided in the joint on the upstream side 270U in the example shown, conversely, the fitting convex portion may be provided on the upstream side and the fitting concave portion may be provided on the downstream side. In that case, the fitting concave portion 75 and the fitting convex portion 76 of the packing 270P (not shown) are provided in a reverse direction.

Figure 24:
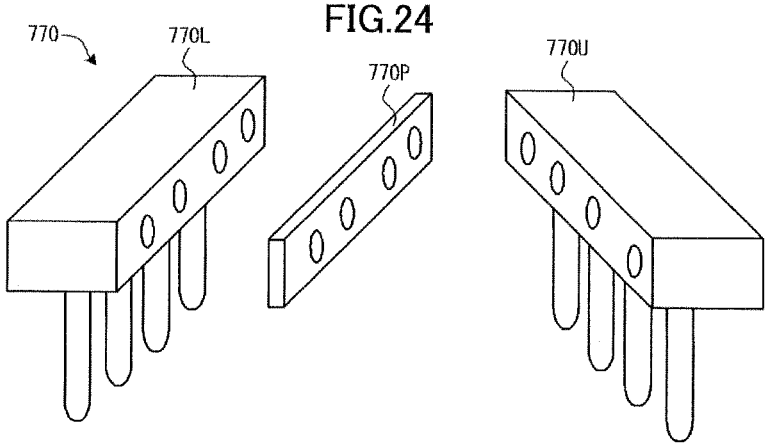
FIG. 24 is a perspective view illustrating an example of a related-art parallel-type joint configuration.

FIG. 24 is a perspective view illustrating an example of a related-art parallel-type joint configuration; in a related art joint 770 shown, multiple paths are arranged in parallel. The respective paths are planarly arranged, so that a distance between neighboring paths is small.

Figure 25:
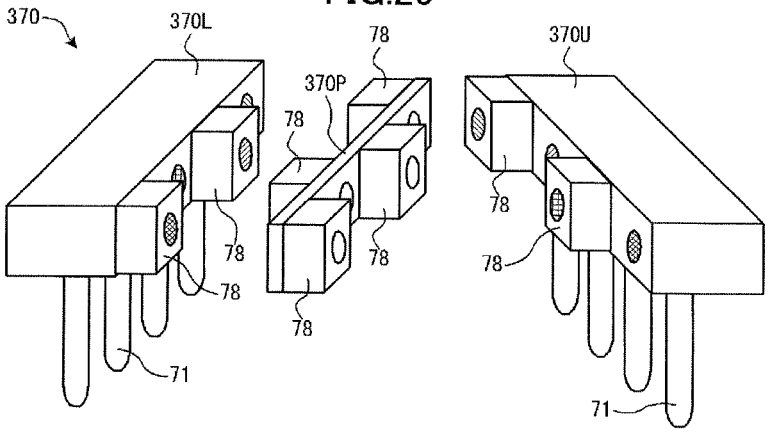
FIG. 25 is a perspective view illustrating a fourth embodiment of the joint configuration.

On the other hand, a joint 370 according to a fourth embodiment shown in FIG. 25 is configured to establish a concave convex relationship between adjacent paths to increase a distance between the adjacent paths to ensure prevention of mixing of ink at the time of mounting and dismounting the joint.

In other words, in the example shown, a concave portion 78 is provided in which a frontmost ink path (black 72K in the example shown) in a figure of the joint on the downstream side 370L and an ink path which is a third one from the frontmost one (cyan 72C in the example shown) are projected. On the other hand, in the joint on the upstream side 370U, a concave portion 78 is provided in which a backmost ink path (yellow 72Y in the example shown) and an ink path which is a second one from the frontmost one (magenta 72M in the example shown) are projected.

The packing 370P has provided two each of the convex portions 78 on one side so as to correspond to each connection face of the joint on the upstream side 370U and the joint on the downstream side 370L. The joint on the upstream side 370U and the joint on the downstream side 370L are coupled with this packing 370P placed therebetween, so that prevention of ink mixing at the time of mounting and dismounting the joint is ensured.

While a frontmost ink path and an ink path which is a third one from the frontmost one are projected in a figure of the joint on the downstream side 370L, a backmost ink path and an ink path which is a second one from the frontmost one are projected in a figure of the joint on the upstream side 370U, and the other ink paths are provided in a non-projecting shape in the example shown, it may be arranged such that the frontmost ink path and the ink path which is the third one from the frontmost one are projected in the figure of the joint on the upstream side 370U, the backmost ink path and the ink path which is the second one from the frontmost one are projected in the figure of the joint on the upstream side 370L, and the other ink paths are provided in the non-projecting shape.

It is also applicable in a configuration with the number of colors of two, three, six, etc., so that the convex portion 78 may be provided on the joint connection face such that adjacent paths have a concave-convex relationship. In other words, for the packing in the above-described case, a concave portion is provided on each connection face on the upstream side and the downstream side such that it corresponds to concave-convexity of the connection face of an opposing joint.

Figure 26:
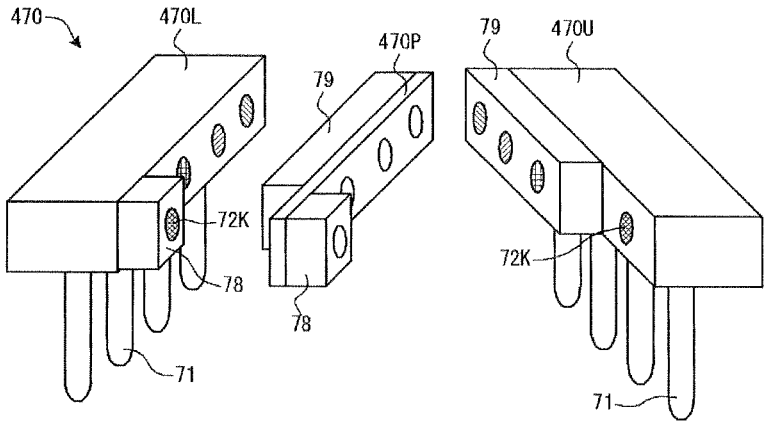
FIG. 26 is a perspective view illustrating a fifth embodiment of the joint configuration.

FIG. 26 shows a fifth embodiment of the joint configuration.

The joint 470 according to the fifth embodiment, which is a parallel-type joint, is configured to provide a concave convex relationship between an ink path of a darkest color and ink paths of the other colors. In the example shown, the frontmost path is a black ink path 72K and the frontmost path of the joint on the downstream side 470L is provided as a concave portion 78, while an ink path for the other three colors is kept planar. On the other hand, conversely, in the joint on the upstream joint 470U, the frontmost ink path 72K of black shown is planarly provided, while ink paths of the other three colors are provided as a wide concave portion 79.

The ink path 72K of black of the joint on the downstream side 470L may be planarly provided, the ink paths of the other three colors may be provided as the wide concave portion 79, the ink path 72K of black of the joint on the downstream side 470U may be provided as the convex portion 78, and the ink paths of the other three colors may be kept planar.

It may also be configured with the number of colors of two, three, six, etc., so that a concave convex relationship may be provided between an ink path of the darkest color and ink paths of other colors. Normally, black is the darkest color, so that the concave convex relationship is provided between the ink path of black and the ink paths of other colors. While mixing of only a few drops of black ink causes color taste of ink of the other colors to change, according to the fifth embodiment a concave-convex relationship is provided between an ink path of the darkest color and an ink path of the other colors, making it possible to efficiently prevent in a simpler configuration a change in color taste due to ink mixing at the time of mounting and dismounting the joint.

Figure 27:
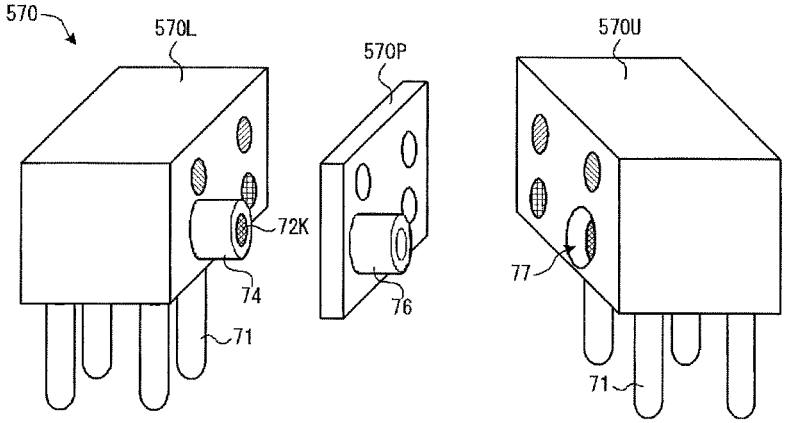
FIG. 27 is a perspective view illustrating the fifth embodiment of the joint configuration.

FIG. 27 shows a sixth embodiment of the joint configuration.

The joint 570 according to the sixth embodiment, which is not a parallel-type joint, is configured to provide a concave convex relationship between an ink path of a darkest color and ink paths of the other colors. In the example shown, two each of four ink paths (of four colors) are aligned in two (upper and lower) steps, so that the ink path in the lower step on the front side shown is an ink path 72K of black, which is the darkest color. In the example shown, the ink path in the lower step on the front side shown of the joint on the downstream side 570L is provided as a fitting convex portion 74. On a face opposing the joint on the downstream side of the packing 570P is formed a fitting concave portion 75 (not shown in FIG. 27; see FIG. 20) into which the fitting convex portion 74 is fitted and on a face opposing the joint on the upstream side of the packing 570P is formed a fitting convex portion 76. Then, in the ink path in a lower step on the front side of a diagram of the joint on the upstream 570U is formed a fitting concave portion 77 into which the fitting convex portion 76 is fitted.

Moreover, in the present example, color mixing is prevented for a case in which ink dripping occurs by, not only the concave convex relationship, but also arranging the ink path of the darkest color (the ink path 72K of black in the example shown) in a lower step.

In this way, in the sixth embodiment, a concave-convex relationship is provided between an ink path of a dark color and ink paths of the other colors and the ink path of the dark color is arranged in a lower step, making it possible to ensure prevent ink mixing at the time of mounting and dismounting the joint.

While the fitting convex portion 74 is provided in the joint on the downstream side 570L and the fitting concave portion 77 is provided in the joint on the upstream side 570U in the example shown, conversely, the fitting convex portion 74 may be provided in the joint on the upstream side 570U and the fitting concave portion 77 may be provided in the joint on the downstream side 570L. In that case, the fitting concave portion 75 and the fitting convex portion 76 that are provided in the packing 570P are provided on a face which is reverse that in the example shown.

Moreover, while an example is shown in which four ink paths (of four colors) are arranged in a quadrilateral (a square or a rectangle), it may also be applied to a configuration is which four paths (ink flow paths) are arranged to be in a diamond shape or in a staggered fashion.

Moreover, while a concave-convex relationship by a fitting convex portion and a fitting concave portion is shown in the example shown, it is also possible to configure using a planar portion and a convex portion (a convex portion 78, etc.) as described in the respective embodiments in FIGS. 25 and 26.

Now, the recording head includes a recording head which is configured to be able to eject multiple colors with one head with multiple nozzle columns arranged. For example, it is the configuration as described in FIGS. 13A to 13C or as shown in FIGS. 28A to 28C.

Figure 28A:
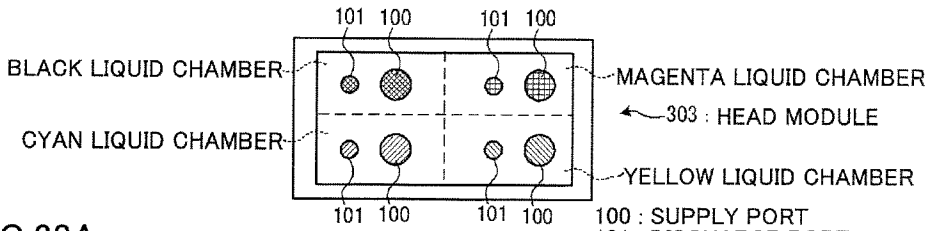
FIGS. 28A to 28C are diagrams illustrating a configuration example of a recording head module which can eject multiple colors.
Figure 28B:
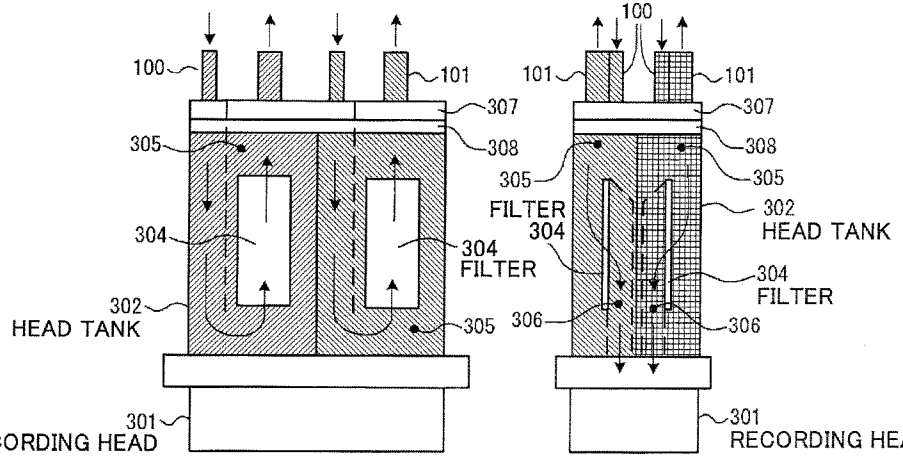
Figure 28C:
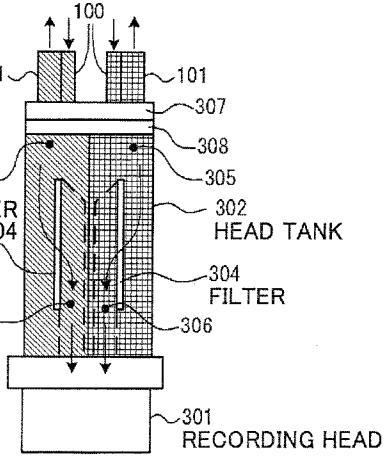

In a head module 303 shown in FIGS. 28A to 28C, a head tank 302 which is divided into multiple chambers is installed at an upper portion of a recording head 301, and a supply port 100 which supplies ink to each chamber and a discharge port 101 which discharges ink from each chamber are provided at an upper portion of the head tank 302. Inside the head tank 302 is divided into four (four chambers) such that four types (K, M, C, and Y) of ink are placed therein, and a filter 304 is arranged in the respective chambers (liquid chambers).

The supply port 100 and the discharge port 101 are provided in a tube connection portion 307, which tube connection portion 307 is mounted at an upper portion of the head tank 302 via the packing 308. As seen from a top view in FIG. 28A, the example shown is configured such that the supply port 100 and the discharge port 101 of each color are positioned and provided on a liquid chamber of each color that is divided into four, K, M, C, and Y.

The filter 304 divides each chamber within the head tank 302 into a liquid chamber on the filter upstream side 305 and a liquid chamber on the filter downstream side 306. The ink entering the liquid chamber 305 on the filter upstream side from the supply port 100 includes that which passes the filter 304 as shown with an arrow in FIG. 28C and that which is sent to the discharge port 101 without passing the filter 304 as shown with an arrow in FIG. 28B. The ink sent to the discharge port 101 side is sent to a mutually adjacent recording head on the downstream side (adjacently connected; not shown). Then, ink moved to the liquid chamber 306 on the downstream side through the filter 304 is sent to the recording head 301 as shown in FIG. 28C.

In the configuration shown, an ink flow is communicatively connected at the liquid chamber 305 on the upstream side of the filter within the head tank 302, making it possible to supply ink to the following head while suppressing flow path resistance as much as possible.

A flexible film (not shown) is adhered onto a side face of the liquid chamber 305 on the upstream side of the filter of the head tank 302 and is provided a role of absorbing pressure fluctuation which occurs due to ON/OFF of the ink flow (a damper function which absorbs the pressure fluctuation).

Figure 29:
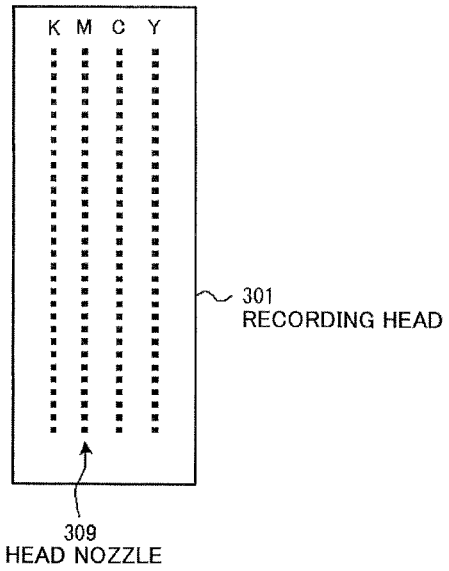
FIG. 29 is a diagram illustrating an ejection face of the recording head which can eject the multiple colors.

As shown in FIG. 29, a nozzle column 309 of four colors of K (black), M (magenta), C (cyan), and Y (yellow) is provided on an ejection face of the recording head 301. Ink sent to the liquid chamber 306 on the downstream side, passing the filter 304 within the head tank 302 sent to a nozzle through a flow path (not shown) provided within a head, and ink is ejected from this nozzle to form an image.

Figure 30:
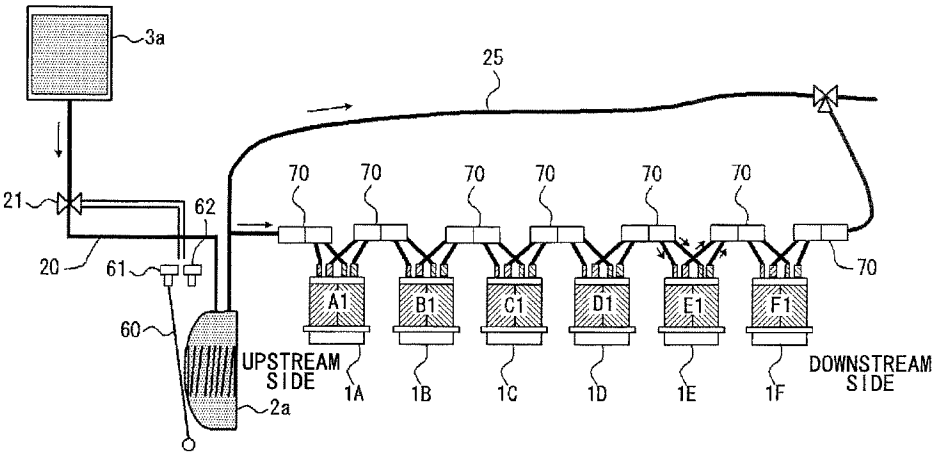
FIG. 30 is a diagram illustrating the ink supply system in a line head in which the head module in FIGS. 28A to 28C is connected in a multiple number.

FIG. 30 is a diagram showing an ink supply system in a line head in which the recording head (the head module 303) as described in FIGS. 28A, 28B, 28C, and 29 in a multiple number (six in the example shown) is connected. As described above, the recording head (head module 303) which is configured as described above includes the supply port 100 and the discharge port 101 for each color of K, M, C, and Y; In order to avoid complexity of the figure, only one is shown respectively for the main tank (ink cartridge) 3*a* and the sub tank 2*a*. Moreover, an ink tube which connects each element is not shown for each color, but only one or two thereof is shown.

In the same manner as what is described in FIG. 16, the ink supply system in FIG. 30 makes it possible to separate and connect the respective recording heads (head modules 303) using the joint 70. In FIG. 30, thicknesses of all of the tubes are shown to be the same.

In the ink supply system in FIG. 30, the ink flows such that it is sent from the ink cartridge 3*a* to the sub tank 2*a*, from the sub tank 2*a* to a head tank on the upstream side A1, and supplied in the order of head tanks on the downstream side B1, C1, D1, E1, and F1.

When replacement of the recording head becomes necessary, a joint 70 installed in a flow path between heads can be separated to replace only the recording head to be replaced.

At the time of a normal ink supply operation, it is performed by detecting an ink amount within the sub tank 2*a*. More specifically, a bulge of a film face of the sub tank 2*a* is amplified by a sensor filler 60, and an amplitude of the sensor filler 60 is detected by the ink empty detection sensor 60 and the ink full detection sensor 61 to suitably control the amount.

When the ink empty detection sensor 62 detected the filler 60, an ink supply valve 21 is opened to supply ink from the ink cartridge 3*a*, while, when the ink full detection sensor 61 detected the filler 60, the ink supply valve 21 is closed to stop ink supply.

Figure 31:
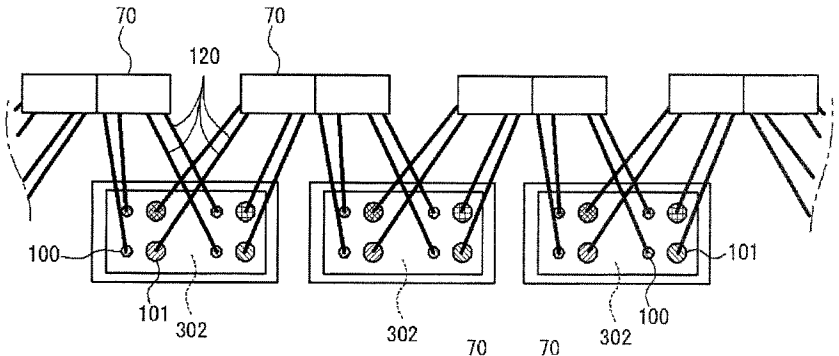
FIG. 31 is a diagram illustrating a state of connecting adjacent head tanks.
Figure 32:
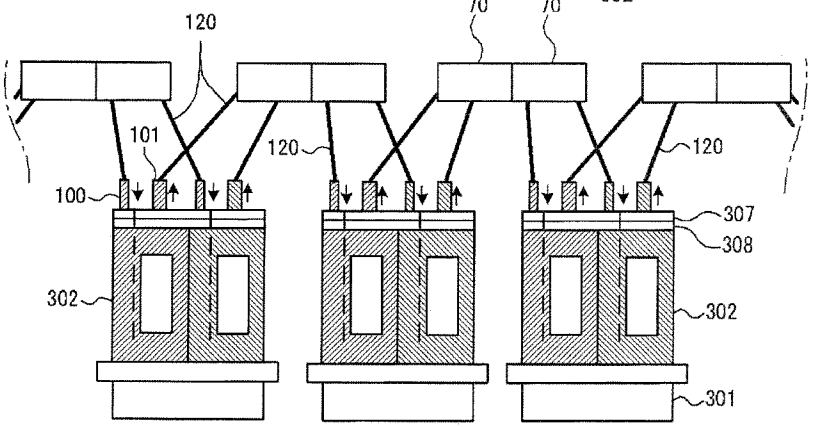
FIG. 32 is a schematic diagram showing the above-mentioned connecting state in a tank side face direction.

FIGS. 31 and 32 are schematic diagrams illustrating a state of connecting adjacent head tanks.

As described above, the head tank 302 is divided into four liquid chambers and the supply port 100 and the discharge port 101 are arranged at an upper portion of the respective liquid chambers. Connecting adjacent head tanks by the tube 120 and the joint 70 causes the tube 120 to cross as shown, making the connection complex.

Moreover, air spreads within the path from the tube, so that the air mixes into ink, causing air bubbles to get into the recording head to lead to ejection failures. Therefore, a tube 120 for use in the embodiments uses a gas barrier tube to which it is difficult for the air to enter over time. The gas barrier tube 120 has a three-layer structure such as NY/EVOH/PE, etc., for example, so that it is very hard. Therefore, due to crossing at the time of connecting the tube, it becomes difficult to bend the tube. Therefore, for a connection form in which the tube 120 crosses as shown in FIGS. 31 and 32, a connection of the joints 70 (a connection between the joints 70) at the time of head replacement becomes very difficult.

Then, in the present invention, a head module which is configured as described below is proposed.

Figure 33A:
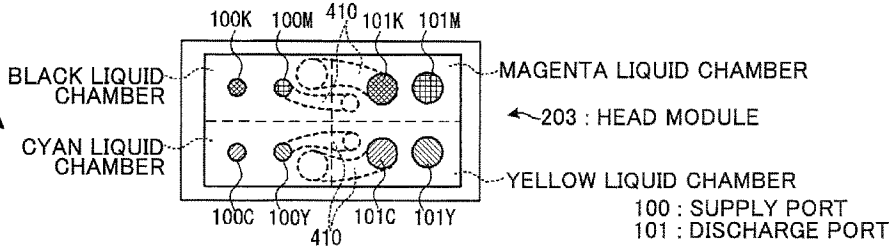
FIGS. 33A to 33C are diagrams illustrating configurations of the head module according to the present invention.
Figure 33B:
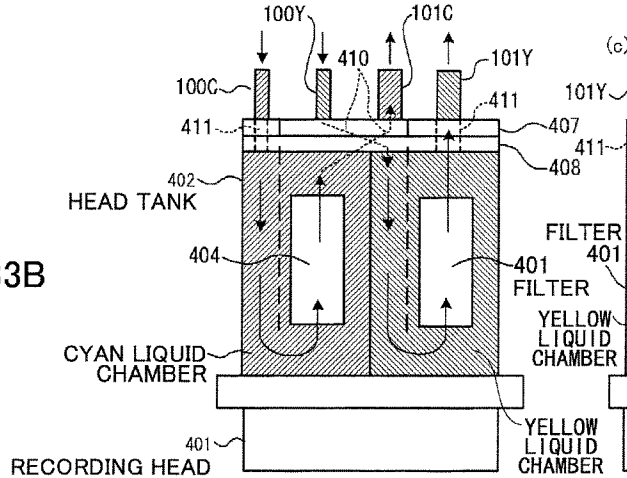
Figure 33C:
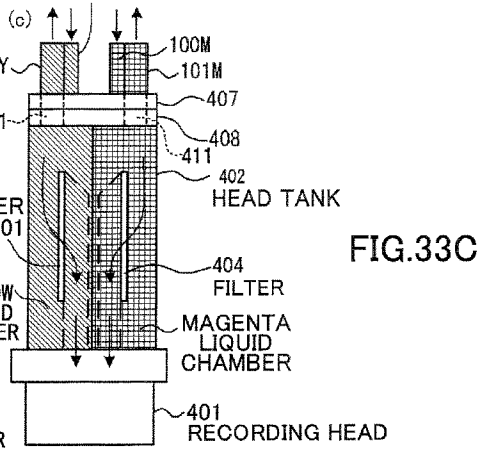

In a head module 403 shown in FIGS. 33A, 33B, and 33C, a head tank 402 which is divided into multiple chambers is installed at an upper portion of a recording head 401, and a supply port 100 which supplies ink to each chamber and a discharge port 101 which discharges ink from each chamber are provided at an upper portion of the head tank 402. Inside the head tank 402 is divided into four (four chambers) such that four types (K, M, C, and Y in the present example) of ink are placed therein, and a filter 404 is arranged in the respective chambers (liquid chambers).

The supply port 100 and the discharge port 101 are provided in the tube connection portion 407, which tube connection portion 407 is mounted at an upper portion of the head tank 402 via the packing (sealing member) 408.

The filter 404 divides each chamber within the head tank 402 into a liquid chamber on the filter upstream side and a liquid chamber on the filter downstream side. The ink entering the liquid chamber 404 on the filter upstream side from the supply port 100 includes that which passes the filter 404 as shown with an arrow in FIG. 33C and that which is sent to the discharge port 101 without passing the filter 404 as shown with an arrow in FIG. 33B. The ink sent to the discharge port 101 side is sent to mutually adjacent recording heads on the downstream side (adjacently connected; not shown). Then, ink moved to the liquid chamber on the downstream side through the filter 404 is sent to the recording head 401 as shown in FIG. 33C.

The configuration of the tube connection portion 407 and the packing 408 differ from that of the tube connection portion 307 and the packing 308 of the head module 303 in FIGS. 28A, 28B, and 28C.

For the head module 403 in FIGS. 33A, 33B and 33C, in FIG. 33A in which the head tank 402 is viewed from the above, the supply port 100 of each color (K, M, C, Y in the present example) is collectively arranged on the upstream side of the tank (the left half side shown), while the discharge ports 101 of the respective colors are collectively arranged on the downstream side of the tank (the right half side shown). Upstream and downstream mean upstream and downstream in an ink supply direction when multiple head tanks (head modules) are connected.

Then, a groove (below-described ink flow path 410, 411) which connects the discharge port 101 and the supply port 100 with the liquid chamber for each color is provided in the tube connection portion 407 and the packing 408.

An ink flow path which connects a supply port of magenta 100M and a magenta liquid chamber; an ink flow path which connects a supply port of yellow 100Y and a yellow liquid chamber; an ink flow path which connects a discharge port 101K of black and a black liquid chamber; and a discharge port of cyan 101C and a cyan liquid chamber is an ink flow path 410 which connects the left side or the right side of the tank with the opposite side thereof, each of which are indicated in dotted lines in FIG. 33A.

On the other hand, a supply port of black 100K, a supply port of cyan 100C, a discharge port of magenta 101M, and a discharge port of yellow 101Y are provided straight above the liquid chamber of each color, so that each of the ports and the liquid chamber of each color are positioned on the same side of the tank. Therefore, the supply port of black 100K, the supply port of cyan 100C, the discharge port of magenta 101M, and the discharge port of yellow 101Y connect to the liquid chamber of each color through the ink flow path 411 which extends straight below from each port. This ink flow path 411 is not shown in FIG. 33A.

In FIG. 33B, the ink flow path 411 which connects the supply port of cyan 100C and the cyan liquid chamber and the ink flow path 411 which connects the discharge port of yellow 101Y and the yellow liquid chamber are indicated in dotted lines. Moreover, in FIG. 33C, the ink flow path 411 which connects the discharge port of yellow 101Y and the yellow liquid chamber and the ink flow path 411 which connects the discharge port of magenta 101M and the magenta liquid chamber are indicated in dotted lines.

Figure 34:
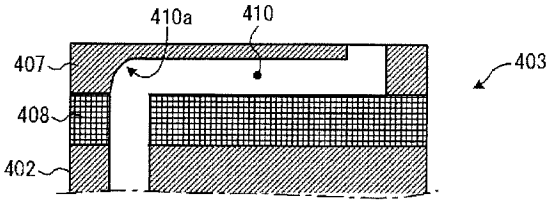
FIG. 34 is a cross sectional diagram illustrating an ink flow path provided in the above-mentioned head module.

FIG. 34 is a cross sectional diagram of the head module 403 that shows a configuration of the ink flow path 410. This cross sectional diagram, which cuts the head module 403 in a head tank longitudinal direction, is a cross sectional diagram in a direction corresponding to FIG. 33B. As shown in FIG. 34, after rising upward from the liquid chamber of the head tank 402, the ink flow path 410 changes a direction thereof to a lateral direction to proceed to the opposite side of the tank and then changes a direction thereof to upward, so that it is bent. In the example shown, a portion (an inflecting portion) 410*a* at which the direction of the flow path changes from an upward direction to a lateral direction is provided in a non-square built smooth shape (an R shape). This inflecting portion 410*a* is provided in an R shape, making it possible to eliminate residual air bubbles within the flow path.

Figure 35A:
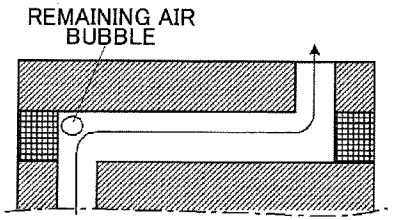
FIGS. 35A and 35B are diagrams for describing a problem in a bent ink flow path.
Figure 35B:
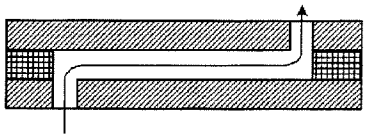

In other words, as shown in FIG. 35A, in the bent ink flow path, air bubbles are likely to accumulate in a bent portion (a square-built portion). When the flow path is narrowed as shown in FIG. 35B in order to eliminate the residual air bubbles, the flow path resistance becomes large, and, as a result, a non-ejection of ink from the recording head may occur.

For the ink flow path 410 in FIG. 34, in an ink flow path with a thickness of a small flow path resistance, the inflecting portion 410*a* is made to be an R shape, making it possible to eliminate residual air bubbles, and, as the flow path resistance is small, ensuring ink ejection from the recording head.

Figure 36:
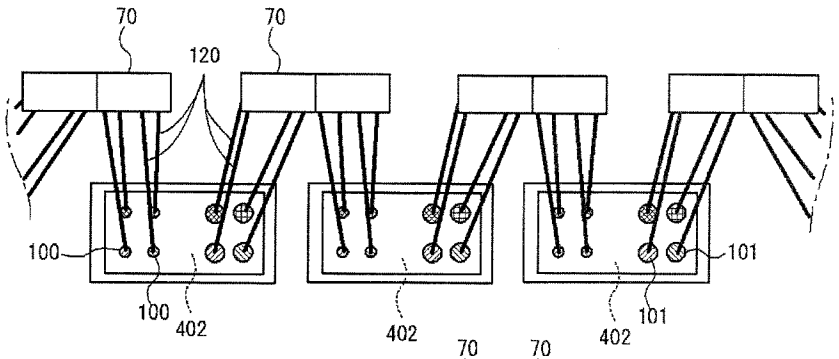
FIG. 36 is a schematic diagram illustrating a state of connecting adjacent head tanks when the head module in FIGS. 33A to 33C is used.
Figure 37:
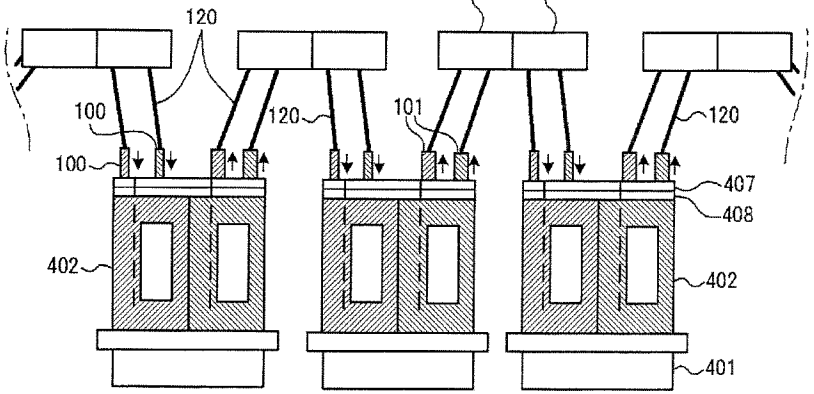
FIG. 37 is a schematic diagram showing the above-mentioned connecting state in the tank side face direction.

FIGS. 36 and 37 are schematic diagrams showing a connection state of an adjacent head tank (head module) when the above-described head module 403 is used.

As described above, the head tank 402 is divided into four liquid chambers of K, M, C, and Y. Then, four supply ports 100 which connect to the liquid chambers of the respective colors are arranged on the left side of the head tank in a figure showing a top face of the head module in FIG. 36. Moreover, four discharge ports 101 which connect to the liquid chambers of the respective colors are arranged on the right side of the head tank. As shown in FIGS. 36 and 37, with a configuration in which the supply ports 100 and the discharge ports 101 are respectively arranged in a collective manner on one side of the head tank 402 (head module 403), a tube 120 (an ink tube) which connects the joint 70 and each port does not cross as shown in FIGS. 36 and 37, simplifying crawling of the tube 120.

In other words, connection between adjacent head tanks 402 (head modules 403) may be greatly simplified. As described previously, the tube 120 for use in the embodiments is difficult to bend since it uses a gas barrier tube into which air is difficult to enter over time. However, the head module 403 configured as described above makes it possible to connect adjacent head modules without the tube 120 crossing as shown in FIGS. 36 and 37. Therefore, removal and connection of the joint 70 at the time of head replacement become easy, making it possible to simplify a task of replacing the head.

Figure 38:
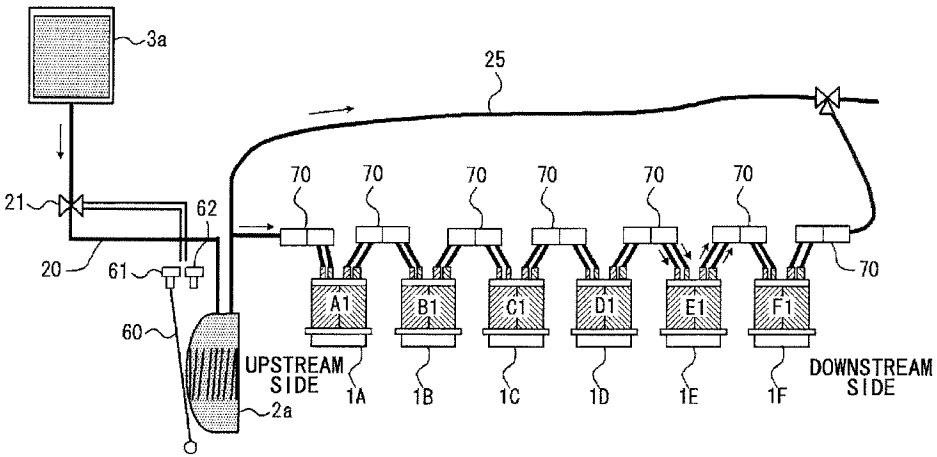
FIG. 38 is a diagram illustrating the ink supply system in the line head in which the head module in FIGS. 33A to 33C is connected in a multiple number.

FIG. 38 is a diagram showing an ink supply system using the head module 403. In the same manner as what is described in FIG. 16, it is made possible to separate and connect the respective recording heads (head modules 403) using the joint 70. In FIG. 38, thicknesses of all of the tubes are shown to be the same. While the upstream and the downstream are shown with the left and the right in reverse relative to the ink supply system in FIG. 16, the basic configurations are the same.

In the ink supply system in FIG. 38, the ink flows such that it is sent from the ink cartridge 3*a* to the sub tank 2*a*, from the sub tank 2*a* to a head tank on the upstream side A1, and supplied in the order of head tanks on the downstream side B1, C1, D1, E1, and F1.

When replacement of the head becomes necessary, a joint 70 installed in a flow path between heads can be separated to replace only a target head (head module). An ink supply operation is the same as that in the ink supply system in FIG. 16, so that explanations are omitted.

Now, as described above, the ink flow path 410 included in the head module 403 is an ink flow path for connecting the supply port 100 or the discharge port 101 to a tank liquid chamber on the opposite side of the side on which the port is arranged, and is to be called a bent ink flow path 410 below.

While an exemplary configuration (embodiment 1) of the bent ink flow path 1 is shown in FIG. 34, other exemplary configurations (embodiments 2-5) of the bent ink flow path 410 are shown in FIGS. 39-42.

Figure 39:
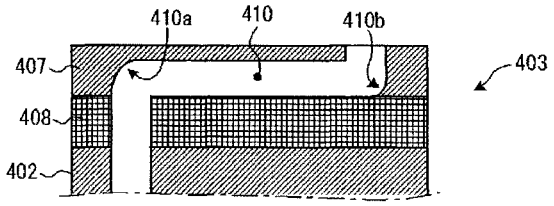
FIG. 39 is a cross sectional diagram illustrating a second embodiment of a bent ink flow path.

In the embodiment 2 of the bent ink flow path 410 that is shown in FIG. 39, an inflecting portion 410*b* at which a direction of a flow path changes from a lateral direction to an upward direction is provided in a non-square built smooth shape (R shape) in addition to an inflecting portion 410*a* at which a direction of the flow path changes from the upward direction to the lateral direction. These inflecting portions 410*a* and 410*b* are provided in an R shape to eliminate a square-built portion of the flow path in which air bubbles are likely to accumulate, making it possible to ensure prevention of air bubbles from being retained within the flow path.

Figure 40:
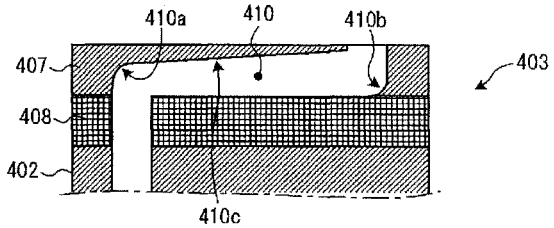
FIG. 40 is a cross sectional diagram illustrating a third embodiment of the bent ink flow path.

The embodiment 3 of the bent ink flow path 410 as shown in FIG. 40 is a configuration in which a ceiling portion 410*c* of the flow path of a laterally-oriented portion is provided as a slanted portion. In the same manner as the embodiment 2, the inflecting portions 410*a* and 410*b* are provided in an R shape. In the configuration of the present embodiment 3, the ceiling 410*c* is provided as the slanting portion, causing air bubbles to become likely to move upward, making it possible to ensure prevention of air bubbles from being retained within the flow path.

The bent ink flow path 410 according to the embodiments 1-3 is a configuration in which the ink flow path is provided in a tube connection portion 407 of the head module. On the other hand, in the embodiment 4 of the bent ink flow path 410 shown in FIG. 41, a groove is provided in both the tube connection portion 407 and the packing 408, so that an ink flow path is configured by both of them. A shape of the bent ink flow path 410 in the embodiment 4 is the same as that in the embodiment 1 (FIG. 34) and in the embodiment 2 (FIG. 39), so that the inflecting portions 410*a* and 410*b* are provided in an R shape. The configuration in the embodiment 4 makes it possible to decrease the thickness of the tube connection portion 407. Moreover, as described in embodiment 5 in FIG. 42, the packing 408 is replaced to make it possible to easily change the flow path shape.

Figure 41:
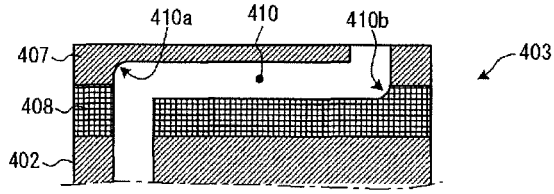
FIG. 41 is a cross sectional diagram illustrating a fourth embodiment of the bent ink flow path.
Figure 42:
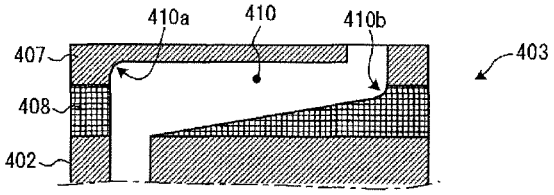
FIG. 42 is a cross sectional diagram illustrating a fifth embodiment of the bent ink flow path.

In the embodiment 5 of the bent ink flow path 410 as shown in FIG. 42, a shape of a groove provided in the packing 408 differs from that in the embodiment 4 in FIG. 41. In other words, in the embodiment 5, a bottom portion of the laterally-oriented flow path is provided as a slanted portion. The configuration of the embodiment 5 decreases flow path resistance and also makes retention of air bubbles into the square-built portion of the flow path more difficult. Moreover, the packing 408 is replaced to make it possible to easily change the flow path shape. While not shown, the ceiling and the bottom of the laterally-oriented flow path may be provided as the slanted portions. Moreover, the head tank side may be projected upward to form the same flow path as in the embodiment 5.

While the present invention has been described above using examples illustrated, it is not limited thereto. The recording head (ejection head) can be configured appropriately, so that, as a pressure generating unit, an arbitrary scheme such as thermal, piezoelectric, electrostatic, etc., can be adopted. The number and the arrangement of the heads and the head modules in the line engine are also exemplary, so that they may be changed appropriately.

The joint configuration is also not limited to the embodiments illustrated, so that the shape and the size, etc., of the convex portion and the planar portion for forming the concave convex relationship and the fitting convex and concave portions may be set appropriately.

Moreover, as an image forming apparatus, the configuration and the shape of each portion can be changed appropriately within the scope of the present invention. The numbers of colors of ink, etc., are also exemplary, so that the present invention can be applied to a configuration in which a number of colors such as six, seven, etc., are used.

The present application is based on Japanese Application No. 2012-064672 filed on Mar. 22, 2012, Japanese Priority Application No. 2012-189740 filed on Aug. 30, 2012, and Japanese Priority Application No. 2013-000427 filed on Jan. 7, 2013, the entire contents of which are hereby incorporated by reference.

The invention claimed is:

1. An inkjet image forming apparatus which is provided with a line engine in which one or multiple recording heads are aligned in a main scanning direction and which has replacably configured an arbitrary one of the recording heads, wherein each of the recording heads includes a head tank mounted on the recording head, the head tank including a supply port and a discharge port for ink, wherein the head tanks which are adjacent are mutually connected by a path in which the discharge port and supply port of the respective head tanks are coupled via a coupling unit, wherein a path from the discharge port and a path to the supply port differ in an inner path diameter over the coupling unit, and wherein the inner path diameter on the discharge port side is larger than the inner path diameter on the supply port side.

2. The inkjet image forming apparatus as claimed in claim 1, wherein the path on the supply port side is set to an inner diameter in which the ink can form and hold meniscus, and wherein the path on the discharge port side is set to an inner diameter in which air bubbles are easy to rise.

3. The inkjet image forming apparatus as claimed in claim 1, further comprising:

a sub-tank for storing the ink, wherein the sub-tank is connected with the supply port of the recording head on the uppermost stream side of the multiple recording heads respectively connected, wherein the discharge port of the recording head on the lowermost stream side of the multiple recording heads respectively connected are connected to a waste liquid flow path via a tri-directional switching valve, and wherein a flow path which is provided with a coupling unit at a tip thereof and which can be coupled to the discharge port of each of the recording heads is connected to the tri-directional switching valve.

4. The inkjet image forming apparatus as claimed in claim 1, wherein a waste liquid flow path is connectably provided at the discharge port of the replaced recording head when the arbitrary recording head is replaced.

5. The inkjet image forming apparatus as claimed in claim 1, further comprising:

a sub tank for storing the ink;

a first supply path which connects the sub tank with the supply port of the recording head on the uppermost stream side of the multiple recording heads respectively connected; and a second supply path which connects the sub tank with the discharge port of the recording head on the lowermost stream side of the multiple recording heads respectively connected, wherein, the second supply path is arranged such that an inner flow path diameter on the upstream side of the coupling unit is larger than an inner flow path diameter on the downstream side of the coupling unit over the coupling unit arranged on the path.

6. The inkjet image forming apparatus as claimed in claim 5, wherein a waste liquid flow path is connected via a tri-directional switching valve to the second supply path.

7. The inkjet image forming apparatus as claimed in claim 1, further comprising a detachable joint which connects an ink path on the upstream side and an ink path on the downstream side, wherein the joint has a member on the upstream side and a member on the downstream side, wherein, in respective connection faces of the member on the upstream side and the member on the downstream side, at least one of the ink paths has a concave-convex relationship relative to the other ink path, and the ink path which has the concave-convex relationship is arranged such that a convex portion of the connection face on one side fits into a concave portion of the connection face on the other side.

8. The inkjet image forming apparatus as claimed in claim 7, wherein the ink paths are arranged in a staggered fashion on the respective connection faces of the member on the upstream side and the member on the downstream side.

9. The inkjet image forming apparatus as claimed in claim 7, wherein at least one of the ink paths is a path for dark color ink.

10. The inkjet image forming apparatus as claimed in claim 1, wherein the recording head is provided with the head tank which includes multiple liquid chambers, so as to be able to eject ink of multiple colors, wherein the head tank includes the supply port and the discharge port for the respective liquid chambers to be provided with multiple supply ports and multiple discharge ports, wherein the multiple supply ports are collectively arranged on the upstream side in an ink supply direction on an upper face of the head tank, and wherein;

the multiple discharge ports are collectively arranged on the downstream side in the ink supply direction on the upper face of the head tank.

11. The inkjet image forming apparatus as claimed in claim 10, wherein the head tanks which are adjacent are configured to be coupled by an ink tube via a detachable joint, and wherein multiple ink tubes which connect the joint and the multiple discharge ports and the multiple supply ports provided in the head tank are arranged such that the multiple ink tubes do not cross.

12. The inkjet image forming apparatus as claimed in claim 10, wherein the supply port and the discharge port are provided in a tube connection portion mounted via a seal member on an upper portion of the head tank.

13. The inkjet image forming apparatus as claimed in claim 12, wherein an ink flow path which connects the liquid chamber and the supply port and an ink flow path which connects the liquid chamber and the discharge port are provided in the tube connection portion and/or the seal member.

14. The inkjet image forming apparatus as claimed in claim 13, wherein an inflection portion at which the direction of the ink flow path changes is provided in a non square-built smooth shape.

15. The inkjet image forming apparatus as claimed in claim 13, wherein a flow path ceiling of a laterally-oriented portion of the ink flow path is provided in a slanted manner.

16. The inkjet image forming apparatus as claimed in claim 13, wherein a flow path bottom of the laterally-oriented portion of the ink flow path is provided in the slanted manner.

* * * * *